US010482728B2

(12) United States Patent
Rosenberg et al.

(10) Patent No.: US 10,482,728 B2
(45) Date of Patent: Nov. 19, 2019

(54) SEGMENTED LIGHT INDICATOR

(71) Applicant: Balluff GmbH, Neuhausen a.d.F. (DE)

(72) Inventors: Thomas Matthew Rosenberg, Union, KY (US); James Clinton Ramler, Burlington, KY (US); Matthew Rommel, Independence, KY (US); Ross T. Terrill, Covington, KY (US); Winfried Erhard Kunzweiler, Ebersbach (DE)

(73) Assignee: Balluff GMBH, Neugausen A.D.F. (DE)

( * ) Notice: Subject to any disclaimer, the term of this patent is extended or adjusted under 35 U.S.C. 154(b) by 0 days.

(21) Appl. No.: 16/107,123

(22) Filed: Aug. 21, 2018

(65) Prior Publication Data

US 2019/0325714 A1 Oct. 24, 2019

Related U.S. Application Data

(60) Provisional application No. 62/659,351, filed on Apr. 18, 2018.

(51) Int. Cl.

| | |
|---|---|
| ***G09F 9/302*** | (2006.01) |
| ***G08B 5/38*** | (2006.01) |
| ***G09F 9/37*** | (2006.01) |

(52) U.S. Cl.

CPC ..... *G08B 5/38* (2013.01); *G09F 9/3023* (2013.01); *G09F 9/375* (2013.01)

(58) Field of Classification Search

CPC ..... G08B 5/38; G09F 9/3023; G09F 9/375; G09F 9/302

See application file for complete search history.

(56) References Cited

U.S. PATENT DOCUMENTS

| | | | | |
|---|---|---|---|---|
| 5,379,198 | A * | 1/1995 | Zhang | B60Q 1/2665 359/844 |
| 7,199,704 | B2 * | 4/2007 | Herrig | B60Q 1/34 315/200 A |
| 2008/0247184 | A1 * | 10/2008 | Matsumoto | B60R 25/2009 362/487 |
| 2016/0275045 | A1 * | 9/2016 | Boutaud | G06F 17/18 |
| 2017/0006693 | A1 * | 1/2017 | Raposo | H05B 37/0263 |
| 2017/0103648 | A1 * | 4/2017 | Bodurka | G08G 1/01 |

* cited by examiner

*Primary Examiner* — Donald L Raleigh
(74) *Attorney, Agent, or Firm* — Frost Brown Todd LLC

(57) ABSTRACT

A light indicator is comprised of six segments or slices that may each be individually and vividly lit with various colors and at various intensities in order to provide information in a point-of-use context, while also minimizing or entirely eliminating bleeding of colored light from one segment to another during use. The light indicator comprises a case containing a processor, memory, and LED controller, and is capable of lighting one or more segments based partially or wholly upon instructions from a remote controller or based entirely on instructions stored in its own memory. In addition to being able to simultaneously light any combination of segments to a desired color and intensity, the indicator is also capable of performing special modes including directional indication, a run mode indication, and a gauge mode indication.

19 Claims, 23 Drawing Sheets

SEGMENTED LIGHT INDICATOR

PRIORITY

This application claims priority to U.S. provisional patent application 62/659,351, filed Apr. 18, 2018, and entitled "Segmented Light Indicator," the disclosure of which is hereby incorporated by reference.

FIELD

The disclosed technology pertains to a segmented light indicator for providing features including a directional indication, a run mode indication, and a gauge mode indication in a work area.

BACKGROUND

Providing information to workers within a manufacturing or supply chain workspace is an important part of ensuring that tasks are performed efficiently, accurately, and safely. Such information can be provided in a variety of ways, and could include flashing lights to alert a worker of danger, a wall mounted display to indicate a work station in need of additional workers, a speaker projecting audio messages across an area, and handheld or wearable electronic devices configured to provide instructional interfaces. Many such conventional devices have disadvantages or limitations which may be undesirable for some implementations.

As an example, a wall mounted display may provide information to ten or more people within a viewable range of the display, but it is less ideal for targeting a message at a single person among the ten. Additionally, a wall mounted display may require a person to turn their head or body away from a task they are working on to view the display. This interrupts their work and could impact the efficiency or safety of the performance of their task. A speaker projecting an audio message is similarly limited in that it is difficult to target a message at a single individual without distracting others. Handheld or wearable electronic devices are more effective at targeting messages to individuals, but, in addition to being expensive and prone to loss or damage as compared to a static fixture, they may draw the user's attention away from the task at hand during interactions with the device.

One way in which some of these limitations are addressed is to provide point-of-use indicators that are designed to provide a message to a worker that relates to a task they are performing and are placed proximate to that task. For example, a conveyor belt may advance whenever a button is depressed by a worker, and the worker may be instructed to press the button whenever the downstream workers are prepared for more work. A point-of-use indicator for this situation might be an indicator light placed next to the button that is either lit green when downstream workers are prepared, or unlit when there is some issue or delay causing them to be unprepared.

In this manner, a worker looking at and pressing the button to advance the conveyor belt will have the indicator light positioned within their line of sight without shifting their attention away from the button they must press. As compared to a system where the worker must stand and peer out across a work floor to visually confirm preparedness of downstream workers, it can be seen how such a point-of-use indicator could increase efficiency by reducing the time between preparedness and a button press and reduce the likelihood of the button being pressed when downstream workers are unprepared.

Conventional point-of-use indicators have struggled to find a balance between the ability to deliver simple messages that are not easily misinterpreted, while still maintaining the flexibility to deliver a wide range of messages. With the prior example, a single green light which can either be lit or unlit only offers two possible states, so while it is unlikely to be misinterpreted it is also of limited use in providing messages.

What is needed, therefore, is an improved system for delivering point-of-use information via lighted indicators.

BRIEF DESCRIPTION OF THE DRAWINGS

The drawings and detailed description that follow are intended to be merely illustrative and are not intended to limit the scope of the invention as contemplated by the inventors.

DETAILED DESCRIPTION

Figure 1:
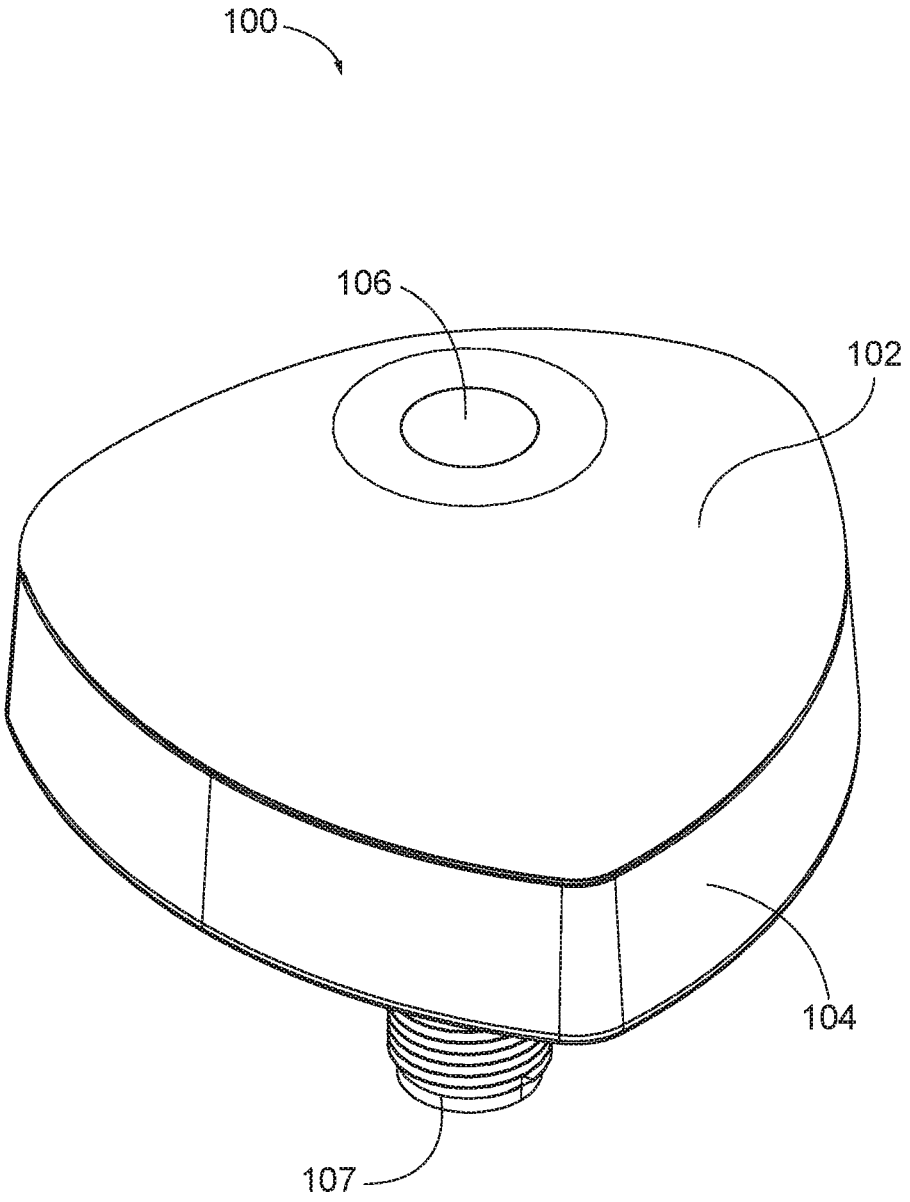
FIG. 1 is a front perspective view of an exemplary light indicator.

The inventors have conceived of novel technology that, for the purpose of illustration, is disclosed herein as applied in the context of light indicators. While the disclosed applications of the inventors' technology satisfy a long-felt but unmet need in the art of light indicators, it should be understood that the inventors' technology is not limited to being implemented in the precise manners set forth herein, but could be implemented in other manners without undue experimentation by those of ordinary skill in the art in light of this disclosure. Accordingly, the examples set forth herein should be understood as being illustrative only, and should not be treated as limiting.

One implementation of the technology disclosed herein is a light indicator that may be used for point-of-use informational signaling for workers in a manufacturing, supply chain, or other setting. Such a light indicator may be visibly placed near a piece of equipment, a conveyor, a bin (i.e., a bin where objects are to be picked from or placed in), and may be lit to provide information to nearby personnel. This could include, for example, indicating that the piece of equipment is currently unusable, indicating a direction that a conveyor is currently moving, or indicating a bin where an item should be pulled from or placed in. Some light indicators may also include sensors configured to detect whether an alert has been acknowledged, or that a task has been completed. This could include, for example, a proximity sensor that may detect the presence of a hand or other object and determine that an item has been pulled from a bin or placed in a bin. Placement of light indicators at a point-of-use allows information to be provided to and received from personnel in a way that does not draw their attention away from the task at hand (e.g., as a notification via a mobile device or a wall mounted display behind them might), and does not confuse nearby personnel (e.g., as a notification via a speaker or wall mounted display visible to many personnel might).

One exemplary light indicator is comprised of six segments or slices that may each be individually and vividly lit with various colors and at various intensities in order to provide information as desired, while also minimizing or entirely eliminating bleeding of colored light from one segment to another during use. The light indicator comprises a case containing a processor, memory, and light emitting diode ("LED") controller, and is capable of lighting one or more segments based partially or wholly upon instructions from a remote controller, or based entirely on instructions stored in its own memory. In addition to being able to simultaneously light any combination of segments to a desired color and intensity, the indicator is also capable of performing special modes including directional indication, a run mode indication, and a gauge mode indication. The features of this implementation and others will be described in more detail below.

Turning now to the figures, FIG. 1 shows an indicator (100) comprising a cover (102) fitted onto a case (104), with a sensor cover (106) that covers a sensor (128) (visible in FIG. 10) positioned so that its sensory range extends upwards and through the sensor cover (106), and a mount (107) extending downwards from the case (104). While some indicators (100) will have sensor (128) and sensor cover (106) in order to detect interactions by personnel (e.g., picking an item from a bin or placing an item in a bin), it should be noted that it is not a required feature. The case (104) may be made of plastic, metal, or other durable materials, and may also be opaque or substantially opaque in order to prevent light from within the indicator (100) bleeding out through the case (104). With reference to FIG. 11, the case (104) has a hollow interior (105) adapted to contain the electronics and other internal components of the indicator (100).

The cover (102) may be formed of plastic, glass, or another material that may be produced with varying levels of translucency. Since the cover (102) is the light emitting portion of the indicator (100) in the shown implementation, translucent materials that allow more light through the cover (102) will result in brighter and more vivid colors being displayed by the indicator (100), but may also allow for colors to bleed from one segment into another through the material of the cover (102). Reducing the amount of light that passes through the cover (102) will reduce the brightness and vividness of the indicator (100), but will prevent or reduce bleed between segments. It should also be understood that in varying implementations of indicators such as the indicator (100), the light emitting portion may be positioned elsewhere (e.g., on a cover, case, or other structure of the indicator).

Figure 2:
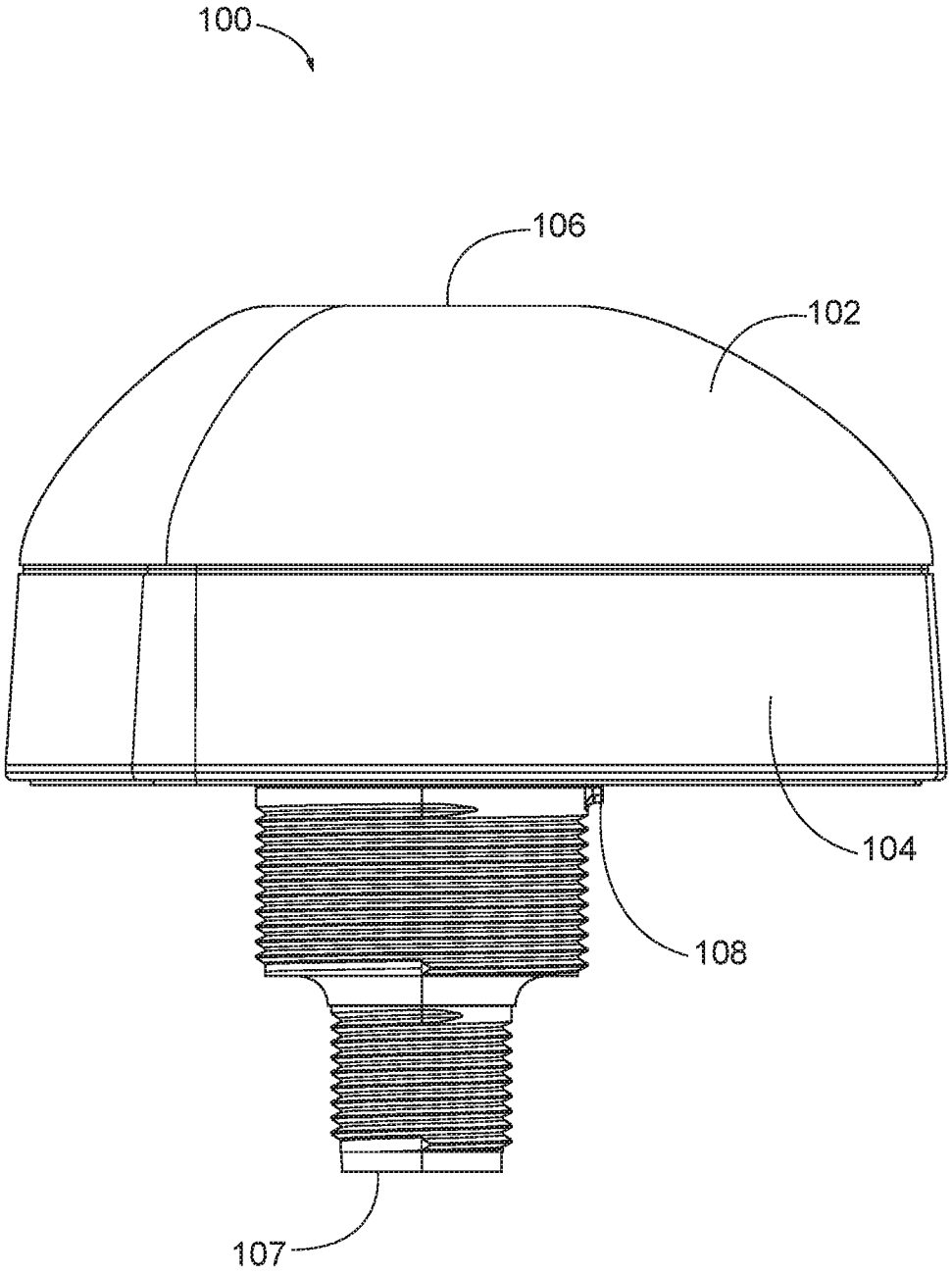
FIG. 2 is an elevation view of the light indicator of FIG. 1.
Figure 4:
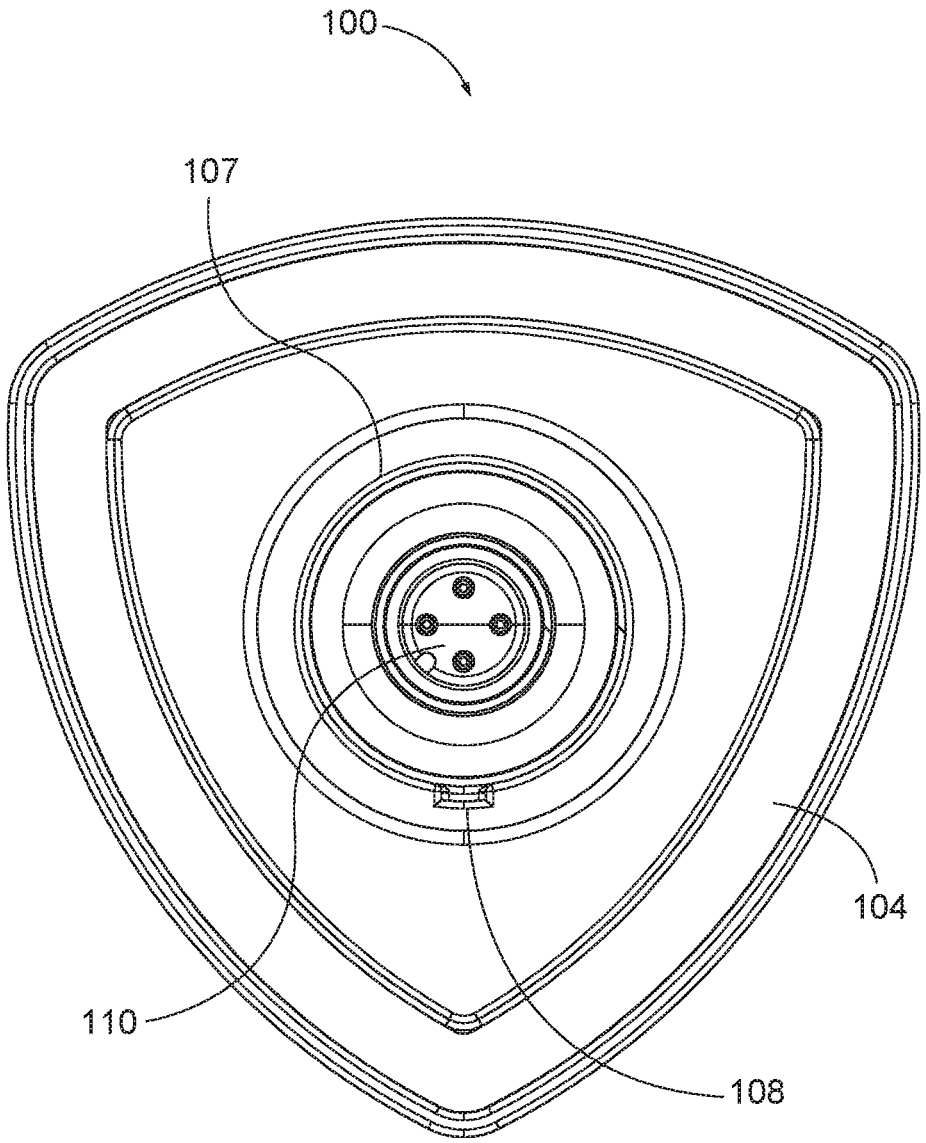
FIG. 4 is a bottom plan view of the light indicator of FIG. 1.
Figure 5:
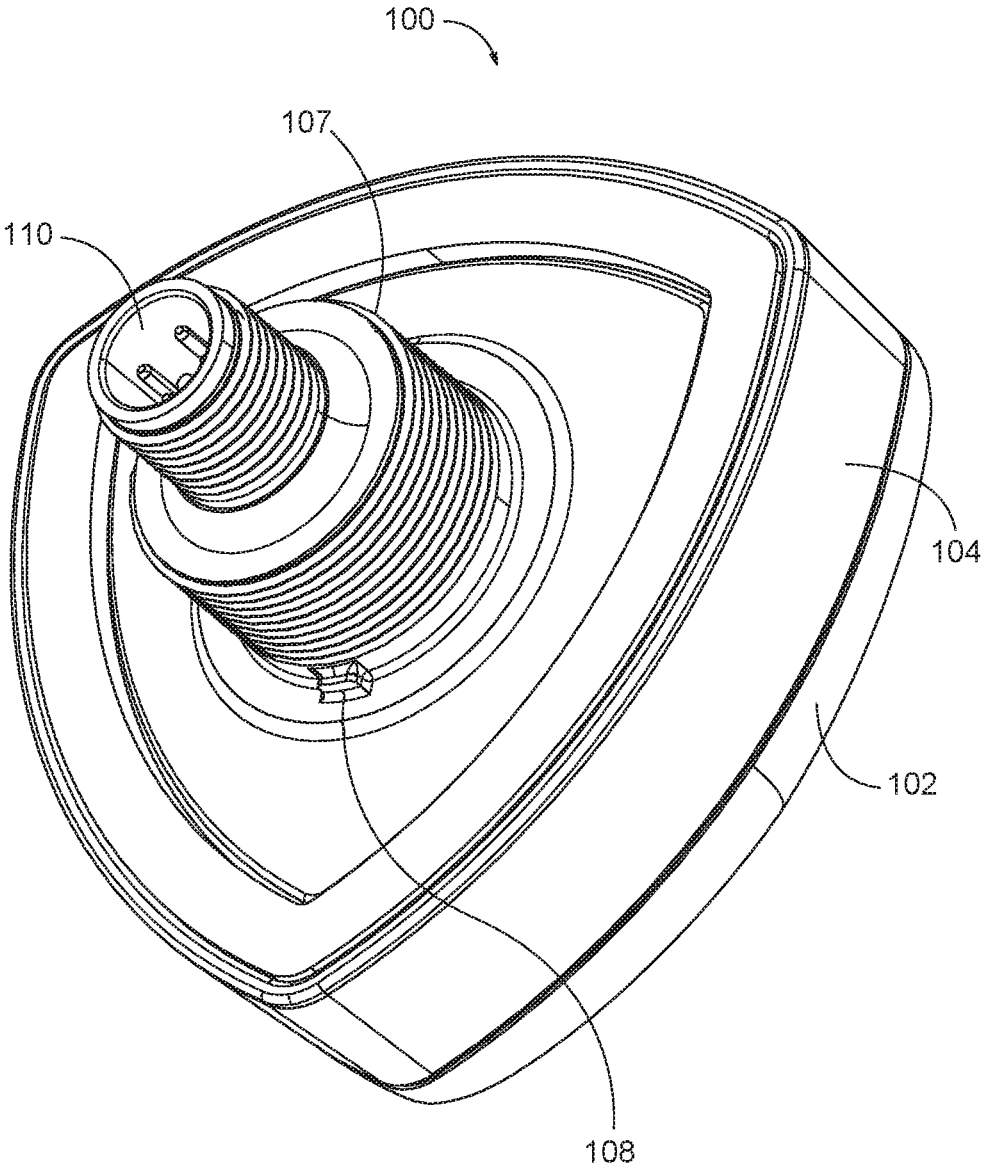
FIG. 5 is a rear perspective view of the light indicator of FIG. 1.

Referring now to FIG. 2, it can be seen that the mount (107) is a threaded post that may be inserted into a mounting hole or slot. The larger diameter threading may then receive a mounting nut in order to secure it in place, while the smaller diameter threading may be used to secure a power and/or data cable or connection to the indicator (100). It should be understood that mount (107) need not be threaded and may take other forms. For example, some mounts (107) may have two or more bolts that may pass through a mounting surface and be bolted in place, or may use other mechanical connections such as hooks, latches, sleeves, or the like. Also shown in FIG. 2, as well as FIGS. 4 and 5, is a positioning key (108) which projects outwards from the mount (107) and may be used to position the indicator (100) with a proper directional orientation during installation when used with a mounting bracket or holder having a matching key slot (not shown). In some installations the directional orientation of the indicator (100) may be important, such as where a directional indication is given by lighting a segment which is known to point in a certain direction (e.g., towards the floor or ceiling, downstream of a work station, upstream of a workstation, or to a worker's left or right).

Figure 3:
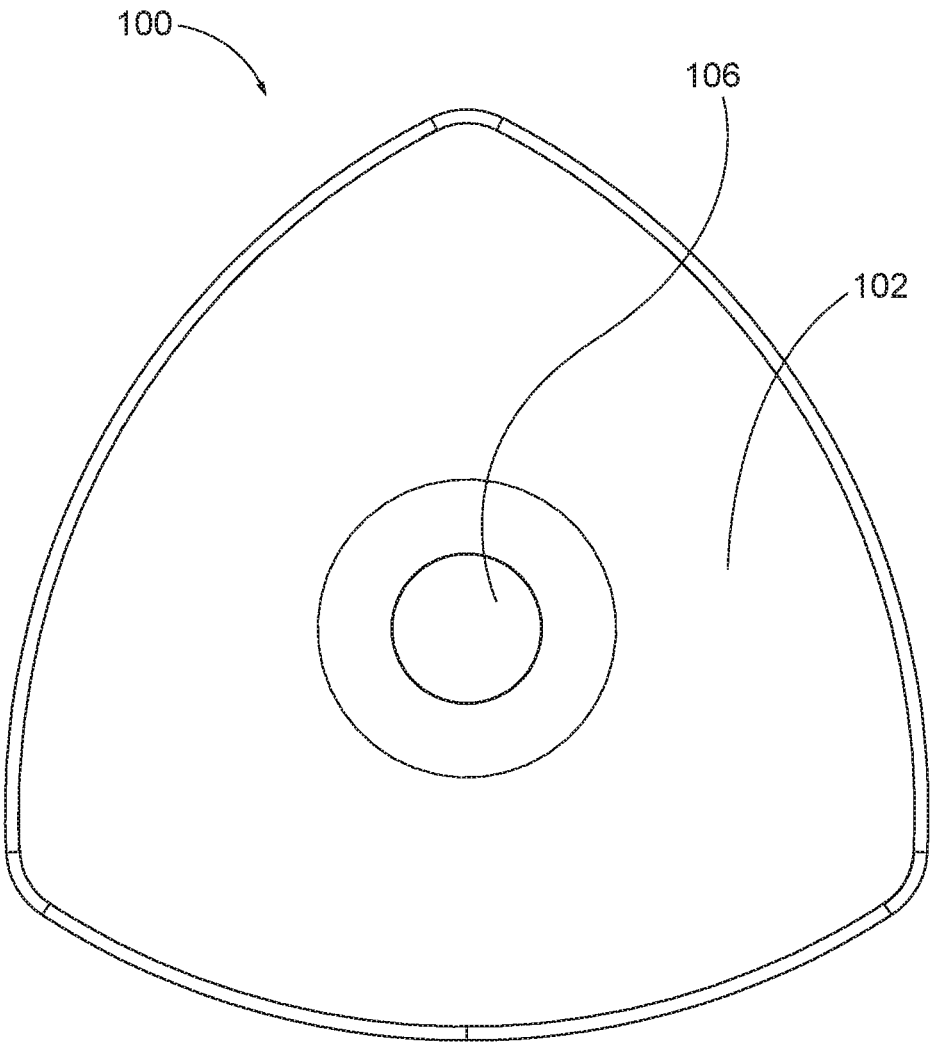
FIG. 3 is a top plan view of the light indicator of FIG. 1.

Referring to FIG. 3, it can be seen that the sensor cover (106) is positioned towards the center of the indicator (100) cover (102) and, with reference to FIG. 2, at the highest point or apex of the cover (102). As has been discussed, the sensor (128) may be configured to detect the presence of an object within a configurable distance of about 1 mm to about 1000 mm of the sensor (128). The sensor (128) may be implemented as, for example, an optical sensor (e.g., photodetector or infra-red sensor) or other proximity sensor (e.g., electromagnetic, thermal, ultrasonic, capacitive, or microwave). Sensors (128) may be useful in applications where the indicator (100) is used to draw a worker's attention to the location of a task, such as pressing a button or retrieving an object, as they may be used to detect and determine when the task can be assumed to be completed (e.g., where the sensor (128) determines that an object of similar size or shape of a hand has passed within 1000 mm of the button or object).

Figure 12:
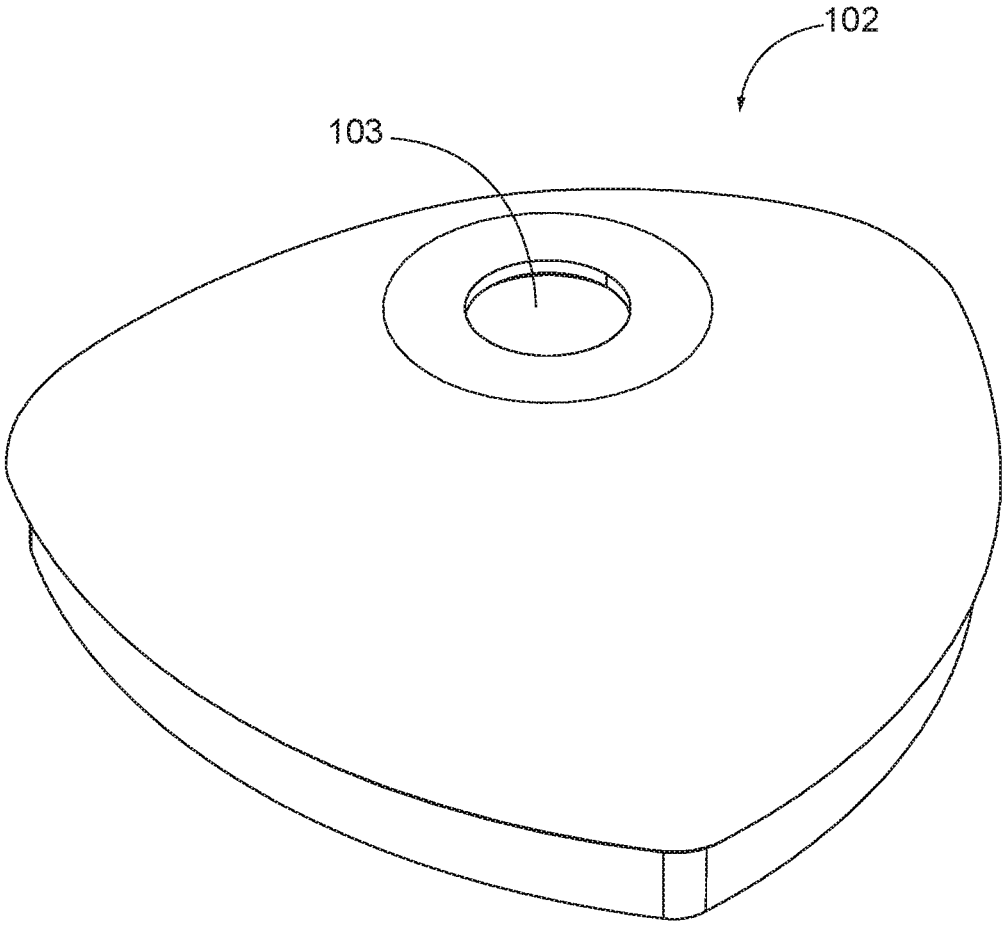
FIG. 12 is a front perspective view of the cover of the light indicator of FIG. 1.

The cover (102) may be formed as a single piece designed to fit into or onto the case (104) and define an aperture (103), as can be seen in FIG. 12, for the sensor cover (106) to be positioned within. The sensor cover (106) protects the sensor (128) and may also provide a filtering effect where the sensor (128) is an optical sensor type. Where the sensor (128) is, for example, an infrared sensor configured to detect proximity and interactions of personnel, the sensor cover (106) may be made from an exemplary material having infrared transmission rates of about 89-91% and haze of about 0.21% or infrared light having a wavelength between about 700 nm and about 1100 nm. While the exemplary material characteristics have been found to be effective, it should be understood that the transmission, haze, infrared wavelength, and other characteristics of the sensor cover (106) may be varied to some extent and still allow the sensor (128) to function. It should also be noted that in some implementations, the cover (102) and the sensor cover (106) may be assembled onto the case (104) and removable, while in others one or both may instead be permanently attached to the case (104) to form a single piece.

It may be desirable to vary the translucency characteristics of the cover (102) in different implementations (e.g., low-light applications, outdoor applications) in order to provide light that is highly visible, but is neither distracting nor confusing. An exemplary material for the cover (102) having translucency characteristics that allow for bright and vivid color display while also substantially preventing confusing bleed-over to other portions of the cover (102) is ALCOM PC 740/4 UV WT1368-04LD, produced by Albis Plastics Corporation, of Duncan, S.C. That material is a polycarbonate with filler material that allows a light transmission of about 74% at about 1.0 mm and a haze of about 96% at about 1.0 mm, which has been found to be suitable for vivid color and light display while minimizing bleeding. However, it should be noted that other materials and other thicknesses ranging between an exemplary range of about 0.2 mm and about 1.5 mm will be appropriate to produce indicators having a desired level of light transmission, with such variations being apparent to one of ordinary skill in the art in light of this disclosure. Additionally, while about 74% light transmission and about 96% haze has been found to be suitable, it will be further apparent to one of ordinary skill in the art in light of this disclosure that a range of light transmissions will be appropriate for different implementations of indicators, and for various purposes (e.g., indicators for dimly lit environments, indicators for long distance or more brightly lit environments), with some exemplary levels of light transmission being between about 60% and about 90%.

FIGS. 4 and 5 show the underside of the indicator (100), where an I/O connector (110) can be seen within the mount (107). The I/O connector (110) may be used to connect one or more cables that provide electrical power and data or other instructions from a remote source to the indicator (100), and may also be used to provide electrical power and data or other instructions to other indicators (100) connected downstream of a particular indicator (100), as will be discussed in further detail below with reference to FIG. 14. Variations on the form and function of the I/O connector (110) exist and will be apparent to one of ordinary skill in the art in light of the teachings herein.

Figure 14:
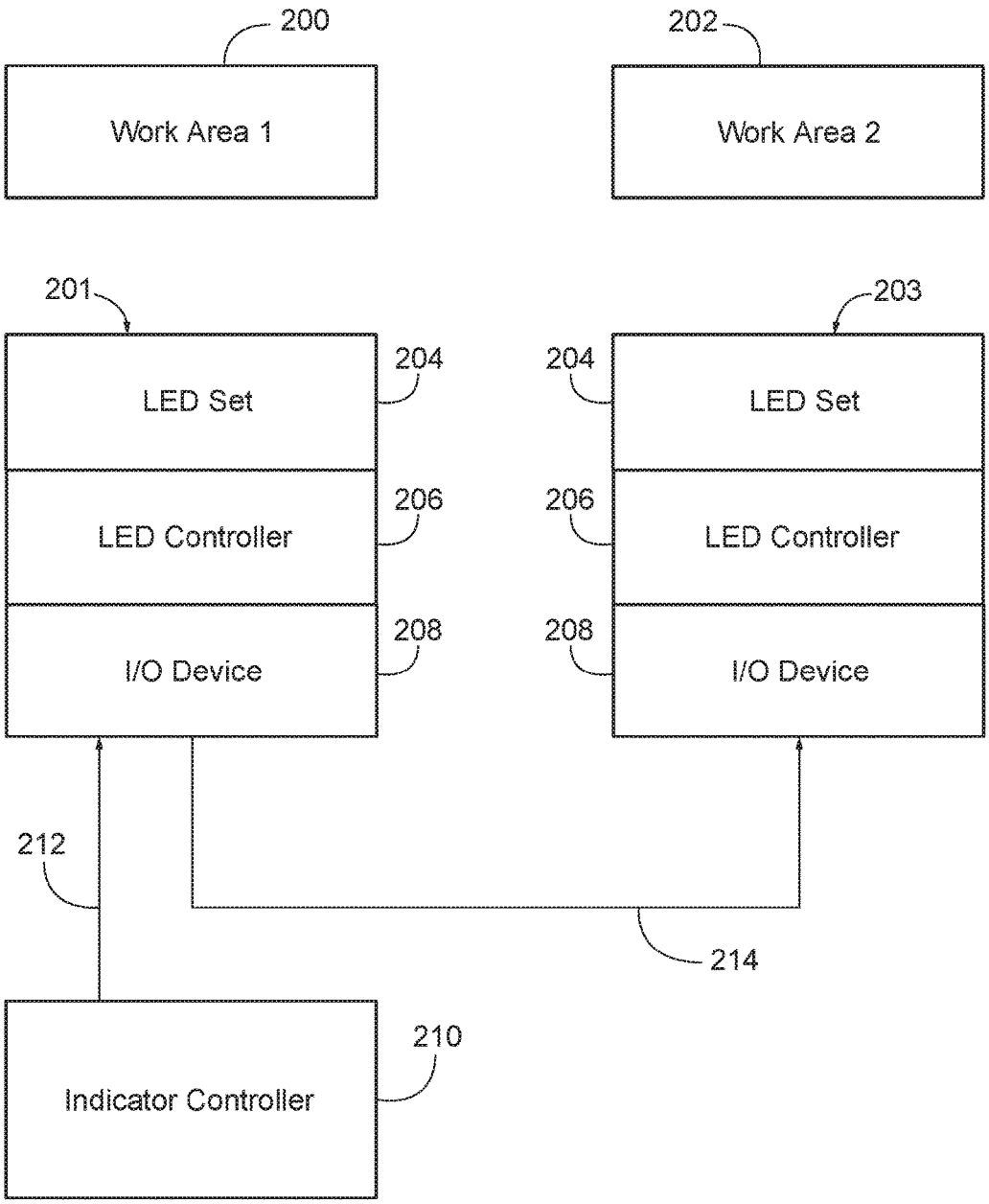
FIG. 14 is a schematic view of the light indicator of FIG. 1 installed for use with an exemplary indicator controller.

For example, in some implementations, the I/O connector (110) may only receive power, while data communications between the indicator (100) and other devices (e.g., other indicators or an indicator controller as described in the context of FIG. 14) may be performed wirelessly by wireless transceivers (e.g., Wi-Fi, Bluetooth, radio) within each indicator or device. In further variations of indicators having wireless transceivers, an indicator may not have an I/O connector (110) at all, and may instead be powered by an internal rechargeable or replaceable battery, to allow for the indicator to be temporarily placed at a point-of-use without hardwired power or data connections. In such an implementation, the indicator may, when placed, receive information from a beacon or other indicator proximate to the placement that may be used to identify the location of the placement and configure that indicator to receive signals intended for that location.

Figure 6:
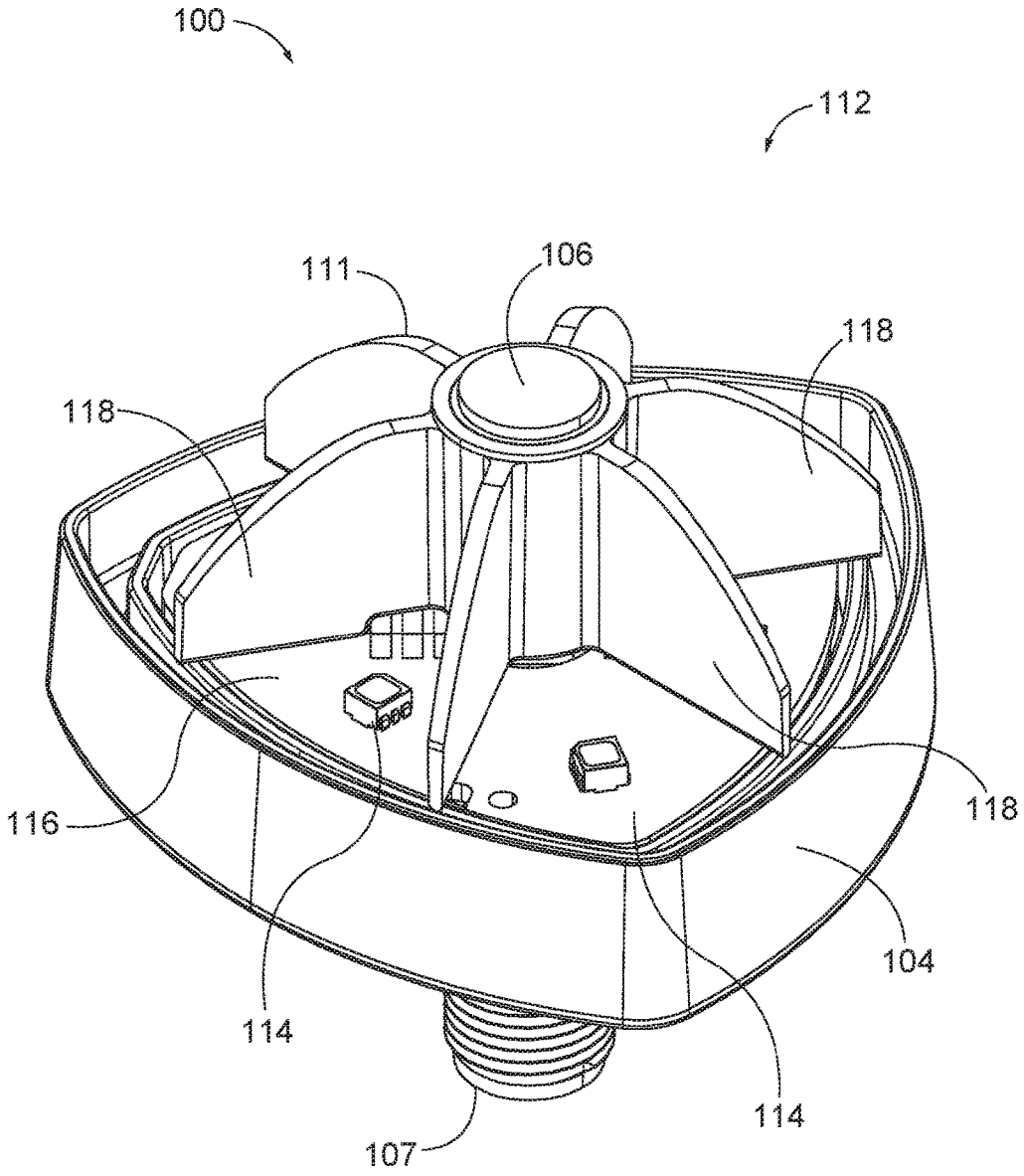
FIG. 6 is a front perspective view of the light indicator of FIG. 1 with an exemplary cover removed.
Figure 7:
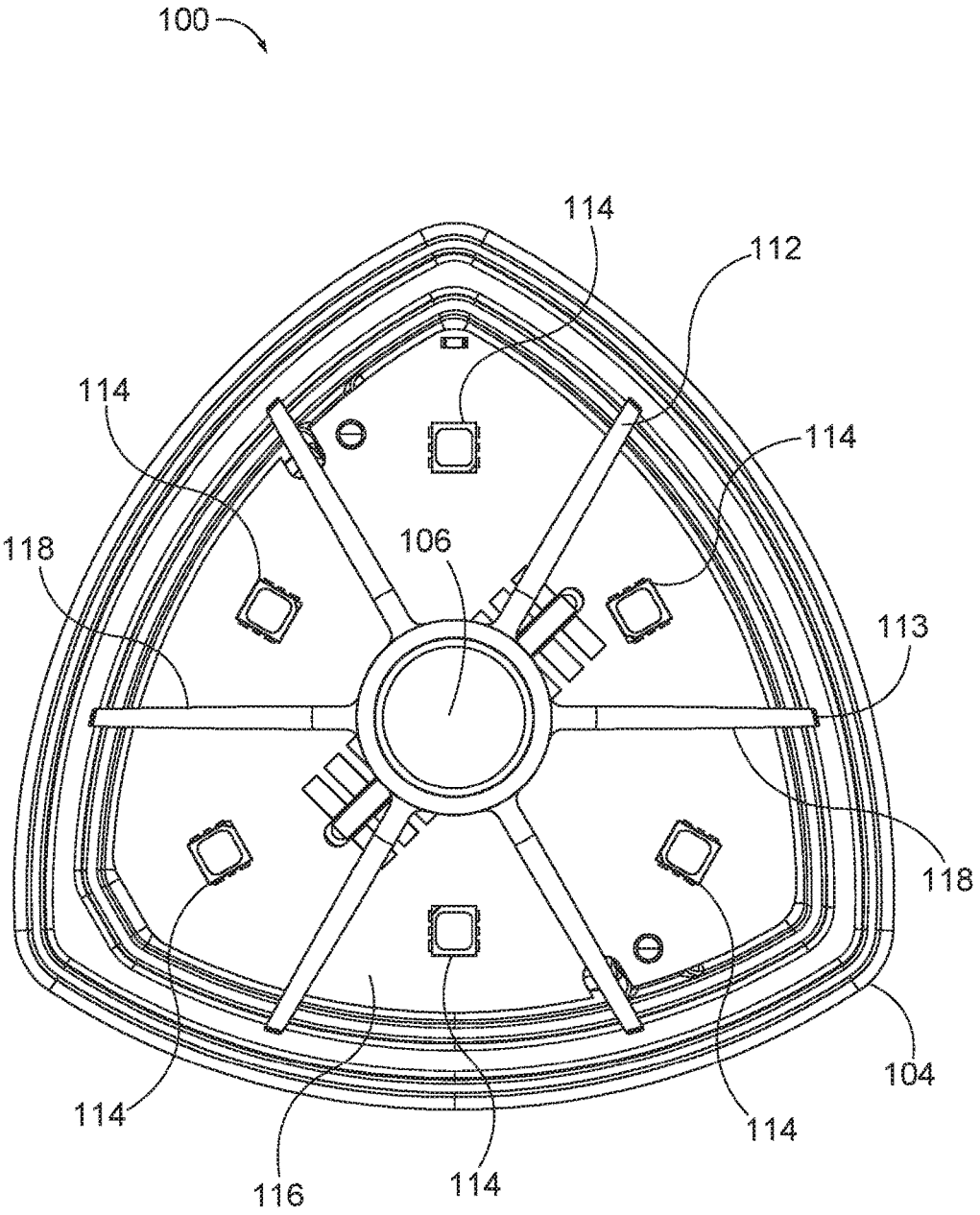
FIG. 7 is a top plan view of the light indicator of FIG. 1 with the cover removed.
Figure 8:
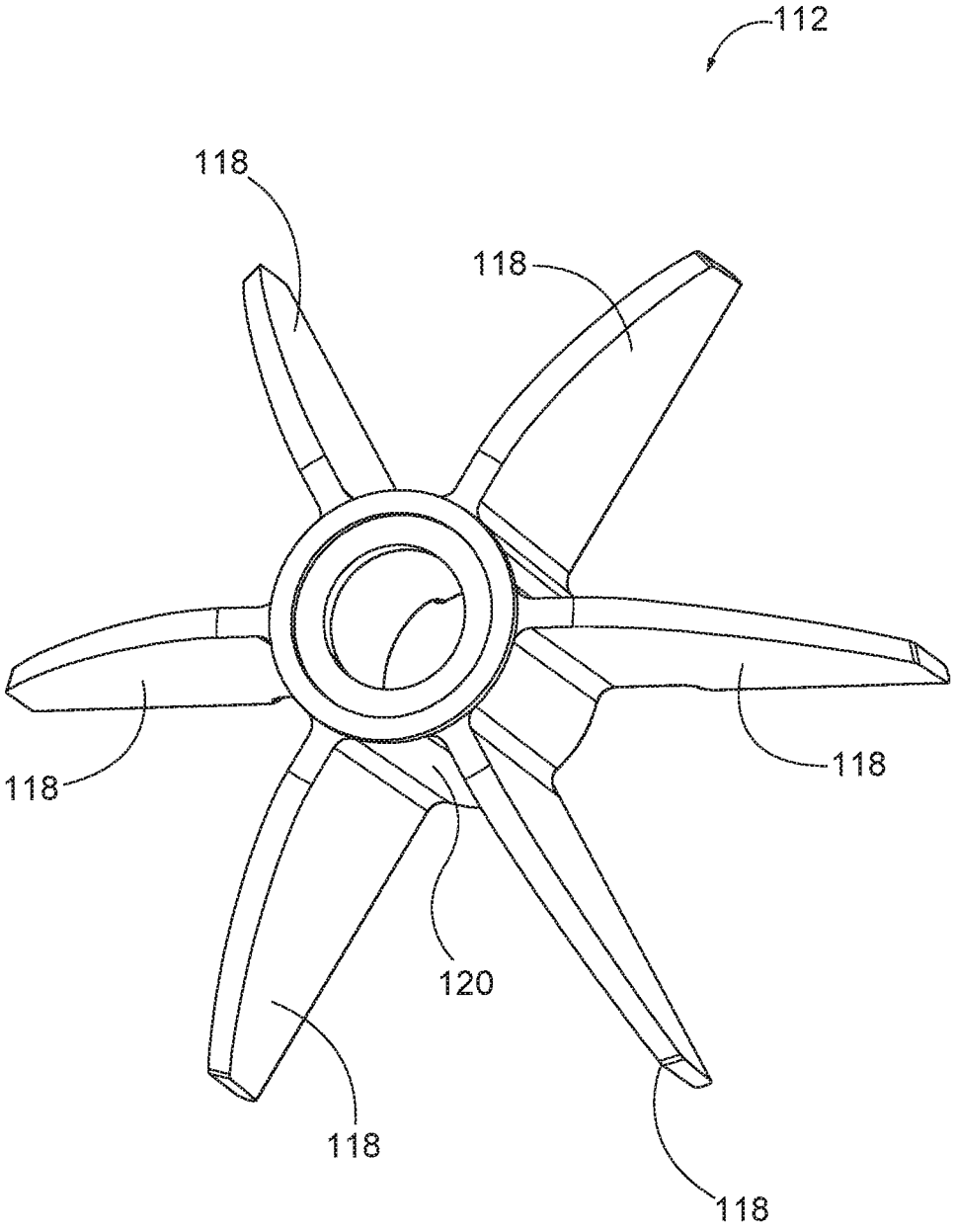
FIG. 8 is a front perspective view of an exemplary divider wheel of the light indicator.

Turning now to FIGS. 6 and 7, those figures show the indicator (100) with its cover (102) removed. An LED shelf (116) is mounted within the case (104), the LED shelf (116) having six LED's (114). The LED shelf (116) serves to both hold and position the LEDs (114) within the indicator (100), and also comprises the circuitry required to send power to the LEDs (114) to cause them to light. A divider wheel (112) is also mounted within the case (104), the divider wheel (112) having six divider spokes (118) that extend outwards from a divider hub (120), as can be seen in FIG. 8. When installed within the case (104), the divider wheel (112) rests on top of the LED shelf (116) and the divider spokes (118) divide the face of the LED shelf (116) into six separate sections, each section containing one LED (114). These LEDs (114) can be activated independently of each other to a desired color and brightness in order to light the section it is placed within. While the shown indicator (100) uses LEDs (114), other lights or light indicators may also be used as may be desirable for a particular implementation. The divider wheel (112) may be separate and removable from the cover (102) and case (104), or may be a portion of, or permanently attached to, one or more of cover (102) and case (104), as may be desirable for a particular implementation (e.g., providing a removable cover (102) and divider wheel (112) to allow for servicing of the indicator (100), providing a single-piece indicator (100) that is sealed against environment hazards).

In some implementations it may be desirable to substantially or entirely prevent light from passing through the divider wheel (112), in order to provide clear differentiation of lighting between segments. An exemplary material that may be used for the divider wheel (112) having characteristics that substantially prevent bleed-over is ALCOM AWL 109/15 WT1217-11LB, produced by Albis Plastics Corporation, of Duncan, S.C. That material is a copolymer of acrylonitrile, butadiene, and styrene, modified with a polycarbonate and containing other fillers, and allows a light transmission of about 0.4% (e.g., substantially opaque but not perfectly opaque) at an exemplary thickness of about 0.5 mm which has been found to be suitable for minimizing bleeding. However, it should be noted that other materials and other thicknesses ranging between an exemplary range of about 0.2 mm and about 1.5 mm will be appropriate to produce indicators having a desired level of light transmission, with such variations being apparent to one of ordinary skill in the art in light of this disclosure. Additionally, while about 0.4% light transmission has been found to be suitable, it will be further apparent to one of ordinary skill in the art in light of this disclosure that a range of light transmissions will be appropriate for different implementations of indicators, and for various purposes (e.g., indicators for dimly lit environments, indicators for long distance or more brightly lit environments), with some exemplary levels of light transmission being between about 0.1% and about 2.0%.

Figure 13A:
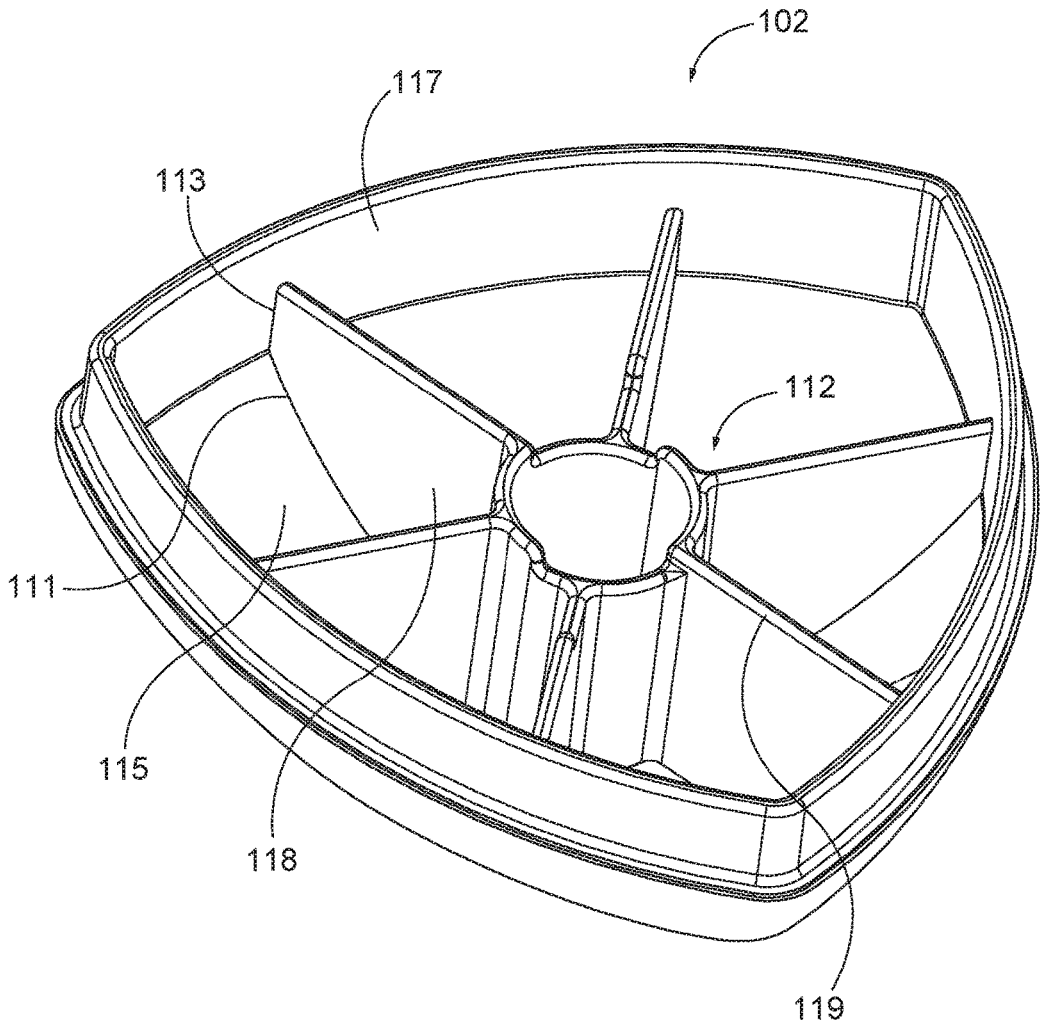
FIG. 13A is a rear perspective view of the cover of the light indicator of FIG. 1 with the divider wheel installed.

Several features prevent light from one sectioned LED (114) from bleeding into another section. With reference to FIG. 13A, the divider spokes (118) are entirely or substantially opaque and each spoke top edge (111) is curved to fit snugly against the interior wall (115) of the cover (102) when the cover (102) is in place. Similarly, the spoke distal edge (113) of each divider spoke (118) will fit tightly against the cover lip (117) of the cover (102) when the cover (102) is in place. As a result, when the cover (102) is in place, and an LED (114) is activated to emit light, the adjacent divider spokes (118), which are opaque, prevent that light from reaching other sections of the indicator (100). The translucent cover (102) allows some emitted light to pass through, but, since the spoke top edge (111) fits against the interior wall (115) of the cover (102) and the spoke distal edge (113) fits against the cover lip (117), light passing through and emitted through the cover is confined to the area or section of the cover (102) between two adjacent divider spokes (118).

In some exemplary implementations the divider spokes (118) may have a thickness of about 1.0 mm at a spoke bottom edge (119) and a thickness of about 1.6 mm at a spoke top edge (111). This tapering of the divider spokes (118) provides an advantage in confining the light from a particular LED such as the LED (114) to a particular segment, as the divider spokes (118) surrounding that particular LED will taper together above it. The tapering of the divider spokes (118) offers an additional advantage in allowing for a draft angle during manufacturing of the divider wheel (112). In addition to being substantially opaque, the divider wheel (114) may be colored white, if maximizing reflection of light from the LED (114) is desirable, or may be colored black, if maximizing absorption of light from the LED (114) is desirable, or other colors in between. These, among other characteristics of the indicator (100), may be varied to achieve the desired range of color and brightness of light emitted by a particular indicator such as the indicator (100).

Figure 13B:
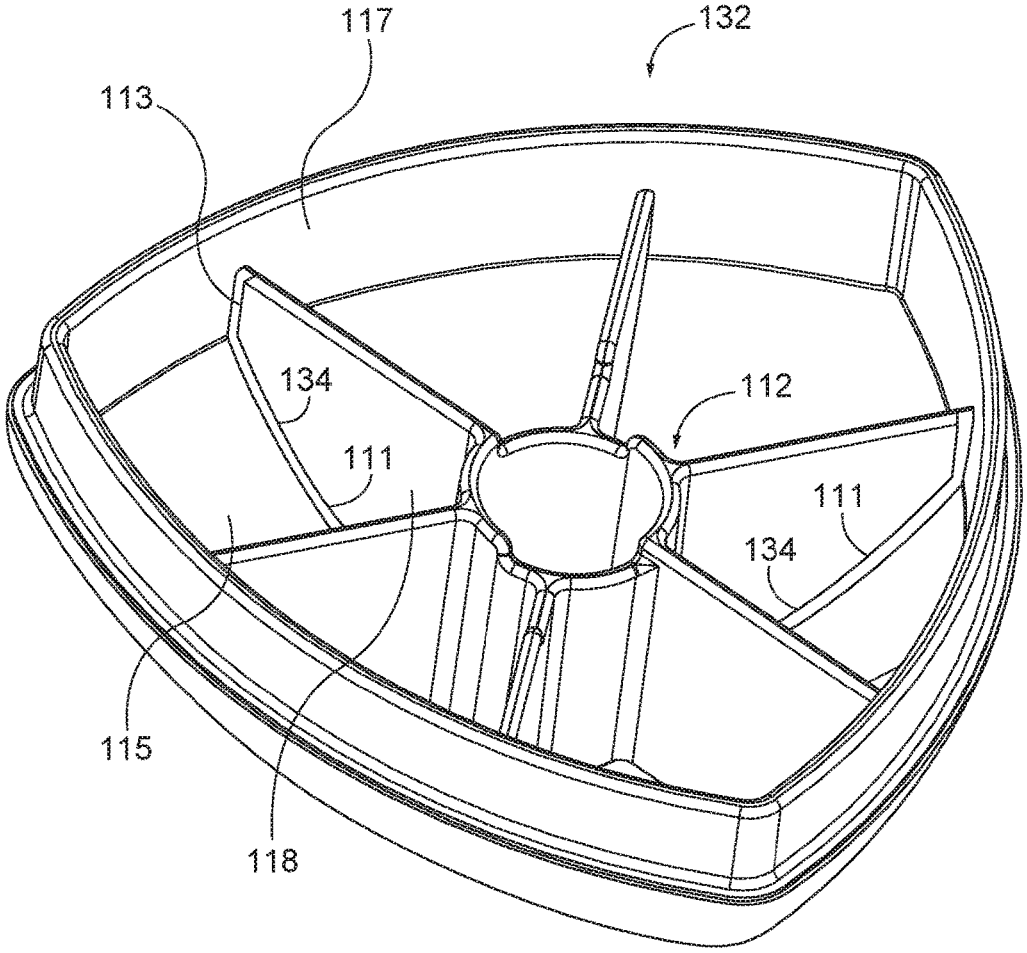
FIG. 13B is a rear perspective view of an alternate exemplary cover of the light indicator of FIG. 1 with the divider wheel installed.
Figure 13C:
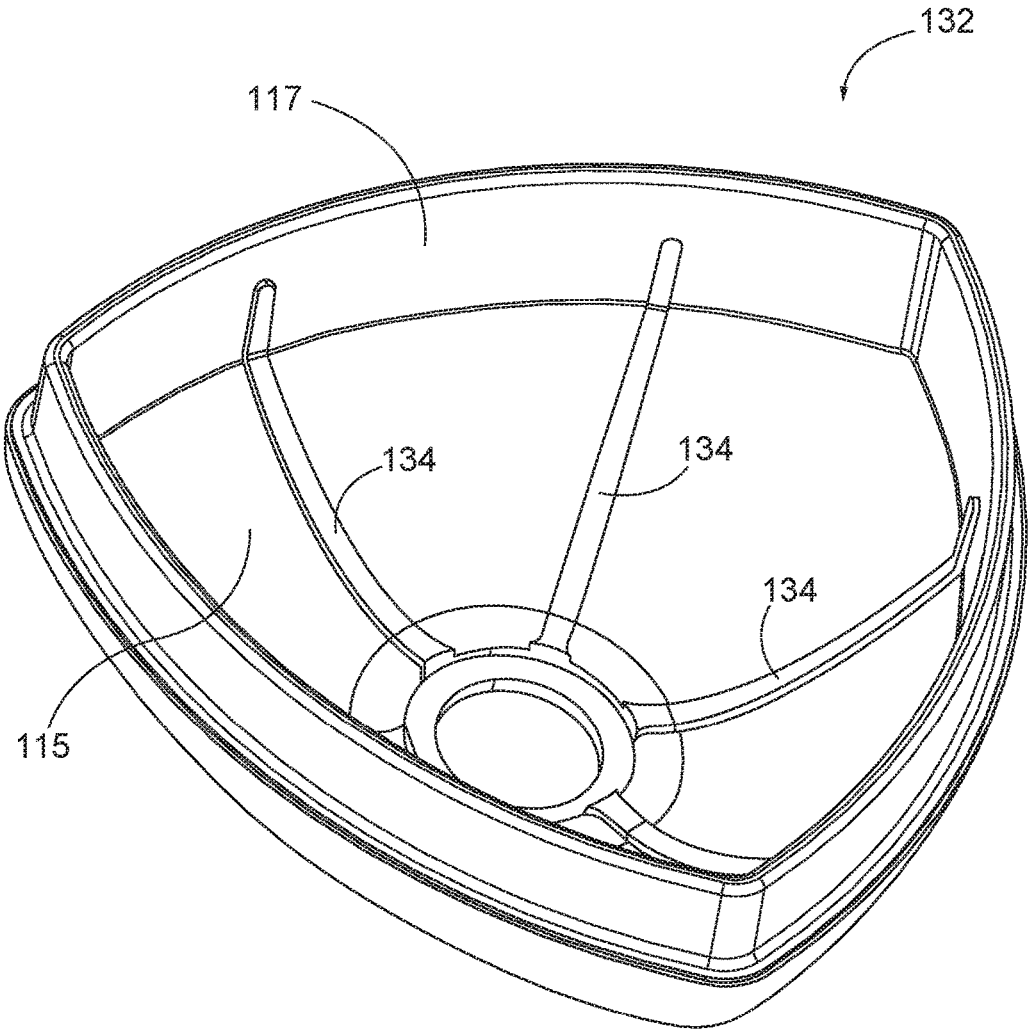
FIG. 13C is a rear perspective view of the alternate exemplary cover of the light indicator of FIG. 1 with the divider wheel removed.

FIG. 13B shows an alternate implementation of a cover (132) and a divider wheel (112), where the cover (132) comprises a plurality of steps (134) extending from the interior of the cover to meet the divider wheel (112). As shown, the plurality of steps (134) extend from the interior wall (115), with each step (134) positioned so that the step (134) is paired with the divider spoke (118) when the divider wheel (112) is installed within the cover (132). The spoke top edge (111) follows the contour of and fits tightly against the step (134). The steps (134) extend from the interior wall (115) between about 0.1 mm and about 1.5 mm and are the same or similar thickness as the spoke top edge (111), which may provide advantages in implementations where the divider wheel (112) is molded or otherwise affixed to the cover (132). The steps (134) of the cover (132) also provide the advantage of reducing flashing between segments and may also minimize the area of reduced or dulled color that may be visible where the spoke top edge (111) directly meets the interior wall (115) in the cover (102) when adjacent segments are lit with different colors. FIG. 13C shows the cover (132) with the divider wheel (112) removed. The steps (134) can be more clearly seen extending from the interior wall (115) and the inside of the cover lip (117) and positioned such that they align with the divider wheel (112) when it is in place.

Figure 9:
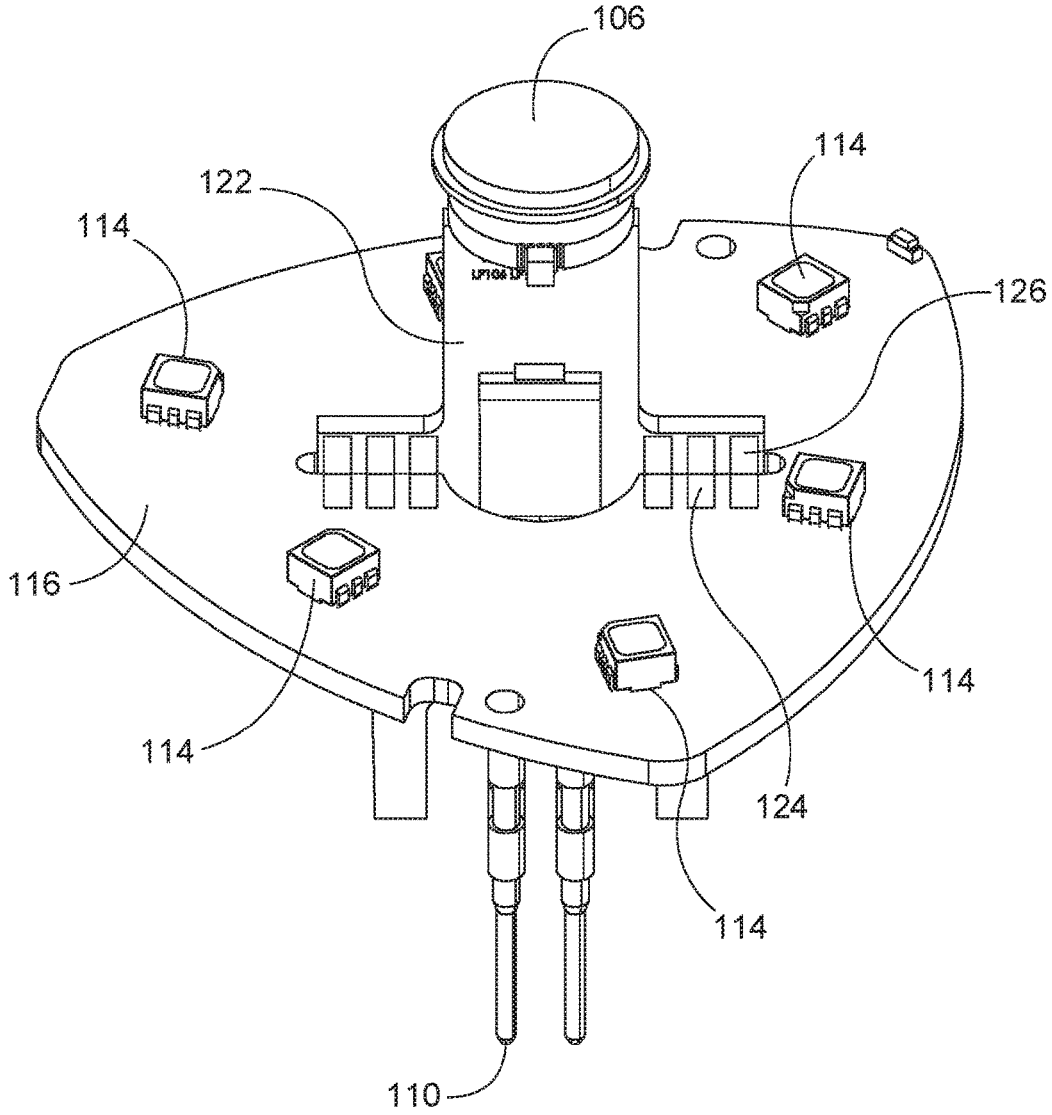
FIG. 9 is a front perspective of the light indicator of FIG. 1 with the cover and an exemplary case removed.

Turning now to FIG. 9, that figure shows an assembled LED shelf (116) and indicator board (122) after removal from the case (104) and removal of the divider wheel (112), with sensor cover (106) still shown in place. The LEDs (114) can be seen more clearly mounted to the LED shelf (116), which itself is connected to the indicator board (122) via conductive shelf connections (124) that are paired with conductive board connections (126) when the LED shelf (116) is in place. The conductive surface connectors (124, 126) allow the indicator board (122) to provide power signals to the LEDs (114), via circuitry either present on the surface of LED shelf (116) or embedded within, that cause one or more of the LEDs (114) to emit light of varying color and brightness. In the shown example, there are six pairs of conductive connectors (124, 126). I/O connector (110) can also be seen extending from the bottom of indicator board (122).

Figure 10:
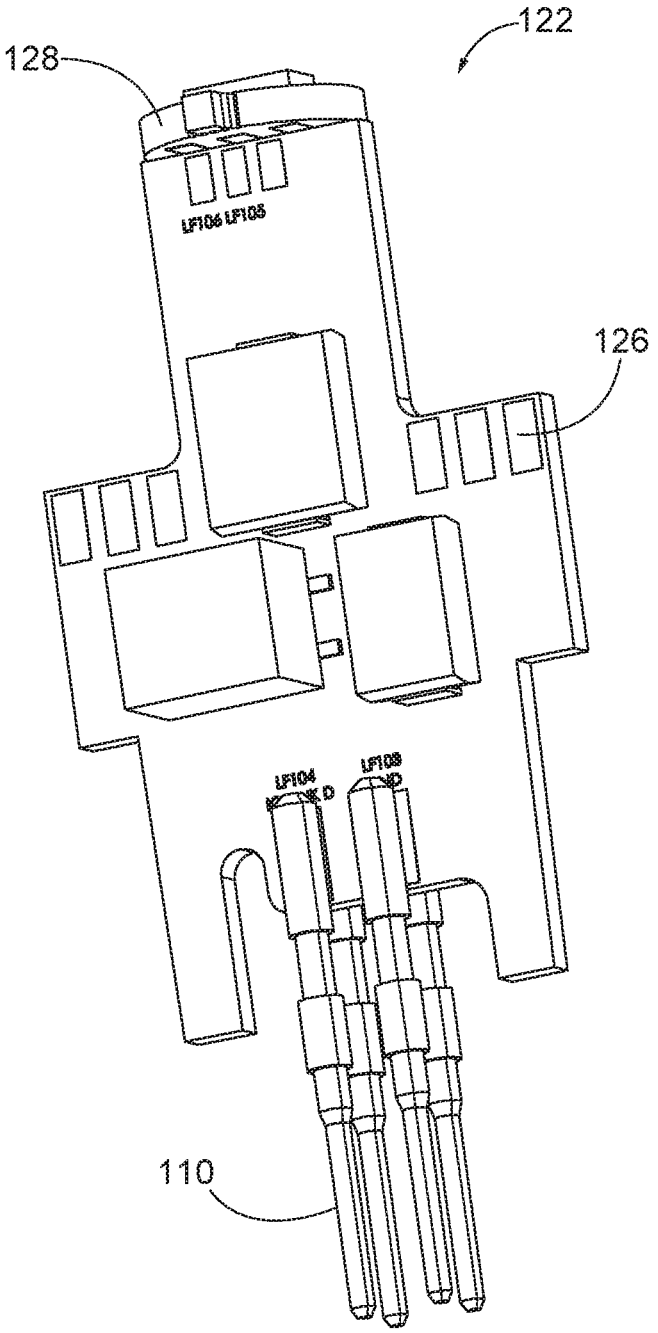
FIG. 10 is a front perspective view of an exemplary indicator board of the light indicator of FIG. 1.
Figure 11:
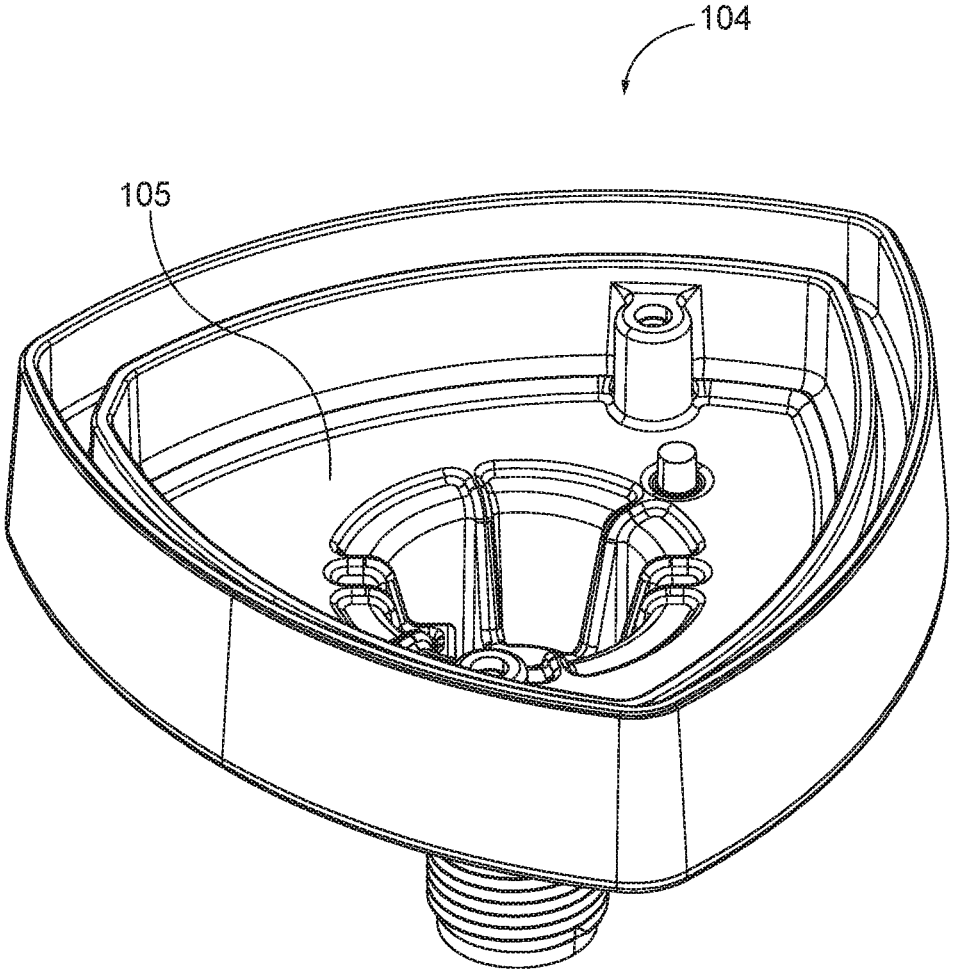
FIG. 11 is a front perspective view of the case of the light indicator of FIG. 1.

The indicator board (122) can be seen more clearly in FIG. 10 where it is isolated from the LED shelf (116). Circuitry present on the surface of or embedded within the indicator board (122) allows power, data, or both to be received or transmitted (i.e., to a downstream indicator (100)) via the I/O connector (110) and utilized by a processor and memory (not pictured, may be mounted to or embedded in LED shelf (116) or indicator board (122)) to perform various functions (e.g., too generate and send signals to one or more LEDs (114) causing them to light, or to cause one or more LEDs (114) to operate in a special mode), to light one or more LEDs (114) via the board connection (126), or to control sensor (128). The processor and memory may be selected based upon the requirements for a particular indicator (100) implementation, but will generally be able to store and execute multiple sets of software instructions relating to operating the LEDs (114), the sensor (128), and sending and receiving power, data, or both via the I/O connector (110).

By having a processor and memory within the indicator (100) itself, communication with the indicator (100) can be simplified. For example, in a particular work environment, a single master indicator computer might provide signals to a plurality of indicators (100). While the indicator (100) could receive a signal from the master computer instructing it to light three of its six segments, this signal could be in different forms. In one form, the signal could be a data packet with three numbers, 1, 3, and 5, indicating that the indicator should light LEDs (114) 1, 3, and 5. In a different form, the signal could be a data packet with a single number, 9, which the indicator (100) could use internally (e.g., by querying a lookup table or providing the input number to a determination function) to determine that it should light LEDs (114) 1, 3, and 5.

It can be seen from this example that the second scenario minimizes the amount of work done by the master computer, and also minimizes the amount of data moved from the maser computer to the indicator (100), which may be advantageous in some implementations. The ability for the indicator (100) to process and act upon its own instructions in this manner may also be useful when placing the indicator (100) into a pre-configured mode, such as directional mode, run mode, or gauge mode, as will be described in further detail below. For example, receiving the input "9" could cause the indicator (100) to immediately enter run mode and sustain it for as long as needed without further instruction, rather than having to receive a continuous sequence of individual instructions.

Turning now to FIG. 14, that figure shows a schematic diagram of a first indicator (201) and a second indicator (203) in use in a work environment. An indicator controller (210) may be one or more computers, machines, or other equipment configured to manage various aspects of the work environment through a digital interface with devices such as the first indicator (201) and the second indicator (203). This digital interface may allow for standardized communication with connected devices using various protocols (e.g., point-to-point serial communication protocol).

One exemplary digital interface is an IO-link adapter or interface that allows the first indicator (201) and the second indicator (203) to be connected to a master assembly for communication with the indicator controller (210). In some implementations, an indicator such as the first indicator (201) may comprise a first IO-link connector (e.g., an IO-link adapter), and the indicator controller (210) or other equipment may comprise a second IO-link connector (e.g., an IO-link interface). The first and second IO-link connectors may be configured to couple and allow the transfer of power and data. Such an IO-link connection may advantageously provide a power supply and a data connection to an indicator such as the first indicator (201) through the same connection, cable, or both, and may considerably reduce the effort and cost of installing and maintaining multiple separate connecting cables. The IO-link connection may also allow for standardized connection to a variety of different machines, equipment, and systems such as the indicator controller (210) or a conveyor belt or other equipment in a work environment.

As an example of a use of the indicator controller (210), in a supply chain setting an indicator controller (210) may receive data indicating a certain item has been ordered, query a database to determine the location of the item within the work environment, send a signal to the first indicator (201) above the container the item is within, and then send a signal to disable the first indicator (201) when data is received from the sensor (128) indicating the item was picked by a worker.

Figure 21:
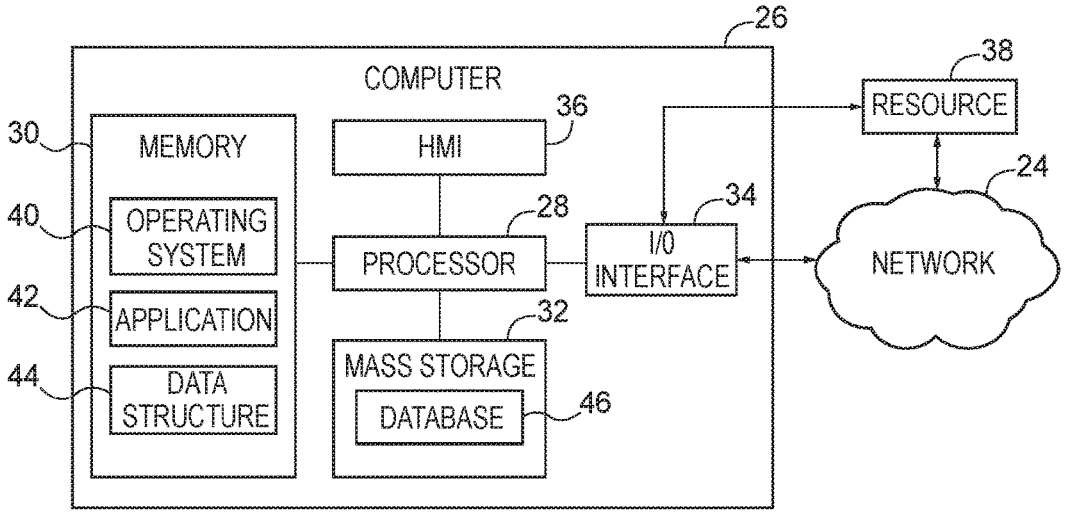
FIG. 21 is a schematic view of an exemplary computer system that may be used to implement the indicator controller of FIG. 14.

FIG. 21 shows a computer system (26) that may be implemented as the indicator controller (210). The computer system (26) may include a processor (28), a memory (30), a mass storage memory device (32), an input/output (I/O) interface (34), and a Human Machine Interface (HMI) (36). Computer system (26) may also be operatively coupled to one or more external resources (38) via network (24) or I/O interface (34). External resources may include, but are not limited to, servers, databases, mass storage devices, peripheral devices, cloud-based network services, or any other suitable computer resource that may used by computer system (26).

Processor (28) may include one or more devices selected from microprocessors, micro-controllers, digital signal processors, microcomputers, central processing units, field programmable gate arrays, programmable logic devices, state machines, logic circuits, analog circuits, digital circuits, or any other devices that manipulate signals (analog or digital) based on operational instructions that are stored in memory (30). Memory (30) may include a single memory device or a plurality of memory devices including, but not limited, to read-only memory (ROM), random access memory (RAM), volatile memory, non-volatile memory, static random-access memory (SRAM), dynamic random access memory (DRAM), flash memory, cache memory, or any other device capable of storing information. Mass storage memory device (32) may include data storage devices such as a hard drive, optical drive, tape drive, non-volatile solid-state device, or any other device capable of storing information.

Processor (28) may operate under the control of an operating system (40) that resides in memory (30). Operating system (40) may manage computer resources so that computer program code embodied as one or more computer software applications, such as an application (42) residing in memory (30), may have instructions executed by processor (28). In an alternative embodiment, processor (28) may execute the application (42) directly, in which case operating system (40) may be omitted. One or more data structures (44) may also reside in memory (30), and may be used by processor (28), operating system (40), or application (42) to store or manipulate data.

I/O interface (34) may provide a machine interface that operatively couples processor (28) to other devices and systems, such as network (24) or external resource (38). Application (42) may thereby work cooperatively with network (24) or external resource (38) by communicating via I/O interface (34) to provide the various features, functions, applications, processes, or modules comprising embodiments of the invention. Application (42) may also have program code that is executed by one or more external resources (38), or otherwise rely on functions or signals provided by other system or network components external to computer system (26). Indeed, given the nearly endless hardware and software configurations possible, persons having ordinary skill in the art will understand that embodiments of the invention may include applications that are located externally to computer system (26), distributed among multiple computers or other external resources (38), or provided by computing resources (hardware and software) that are provided as a service over network (24), such as a cloud computing service.

HMI (36) may be operatively coupled to processor (28) of computer system (26) in a known manner to allow a user to interact directly with computer system (26). HMI (36) may include video or alphanumeric displays, a touch screen, a speaker, and any other suitable audio and visual indicators capable of providing data to the user. HMI (36) may also include input devices and controls such as an alphanumeric keyboard, a pointing device, keypads, pushbuttons, control knobs, microphones, etc., capable of accepting commands or input from the user and transmitting the entered input to processor (28).

A database (46) may reside on mass storage memory device (32), and may be used to collect and organize data used by the various systems and modules described herein. Database (46) may include data and supporting data structures that store and organize the data. In particular, database (46) may be arranged with any database organization or structure including, but not limited to, a relational database, a hierarchical database, a network database, or combinations thereof. A database management system in the form of a computer software application executing as instructions on processor (28) may be used to access the information or data stored in records of database (46) in response to a query, where a query may be dynamically determined and executed by operating system (40), other applications (42), or one or more modules.

The indicator controller (210) may be connected via a cable (212) to the first indicator (201) located at a first work area (200). Power and instructions may be supplied to the first indicator (201) via the cable (212) and received by an I/O device (208) of the first indicator (201). The power and instructions may then be used by a controller such as an LED controller (206) of the indicator (100) to determine one or more LEDs that should be activated from an LED set (204), and the color and intensity of the light they should emit, and then provide instructions and power to the LED set (204) to cause the desired light output. A cable (214) also runs from the I/O device of the first indicator (201) to the second indicator (203). With this type of configuration, a first indicator (201) may receive some instructions from the indicator controller (210) that cause it to emit light and may forward some or all those instructions to cause the same or a different response to one or more subsequently attached indicators such as the second indicator (203).

In implementations where the indicator controller (210) or another machine or equipment (e.g., a conveyor located at work area (200)) is coupled with indicators such as the first indicator (201) using a digital interface such as an IO-link interface, the I/O device (208) may be an IO-link adapter, and the cable (212) may be connected to, or an endpoint of, an IO-link interface. Other variations on IO-link implementations of work environments such as that shown in FIG. 14 exist and will be apparent to one of ordinary skill in the art in light of the disclosure herein.

For example, indicator controller (210) may send a data packet to indicator (201) that contains separate instructions for both the first indicator (201) and the second indicator (203). The first indicator (201) may receive the instructions and, while performing them, send the second set of instructions to the second indicator (203). This configuration may be advantageous in that behavior can be more easily mirrored or synced across multiple indicators, and also may reduce the length and cost of cables compared to a configuration where indicator controller (210) is directly connected to each and every indicator in a work environment.

Figure 15:
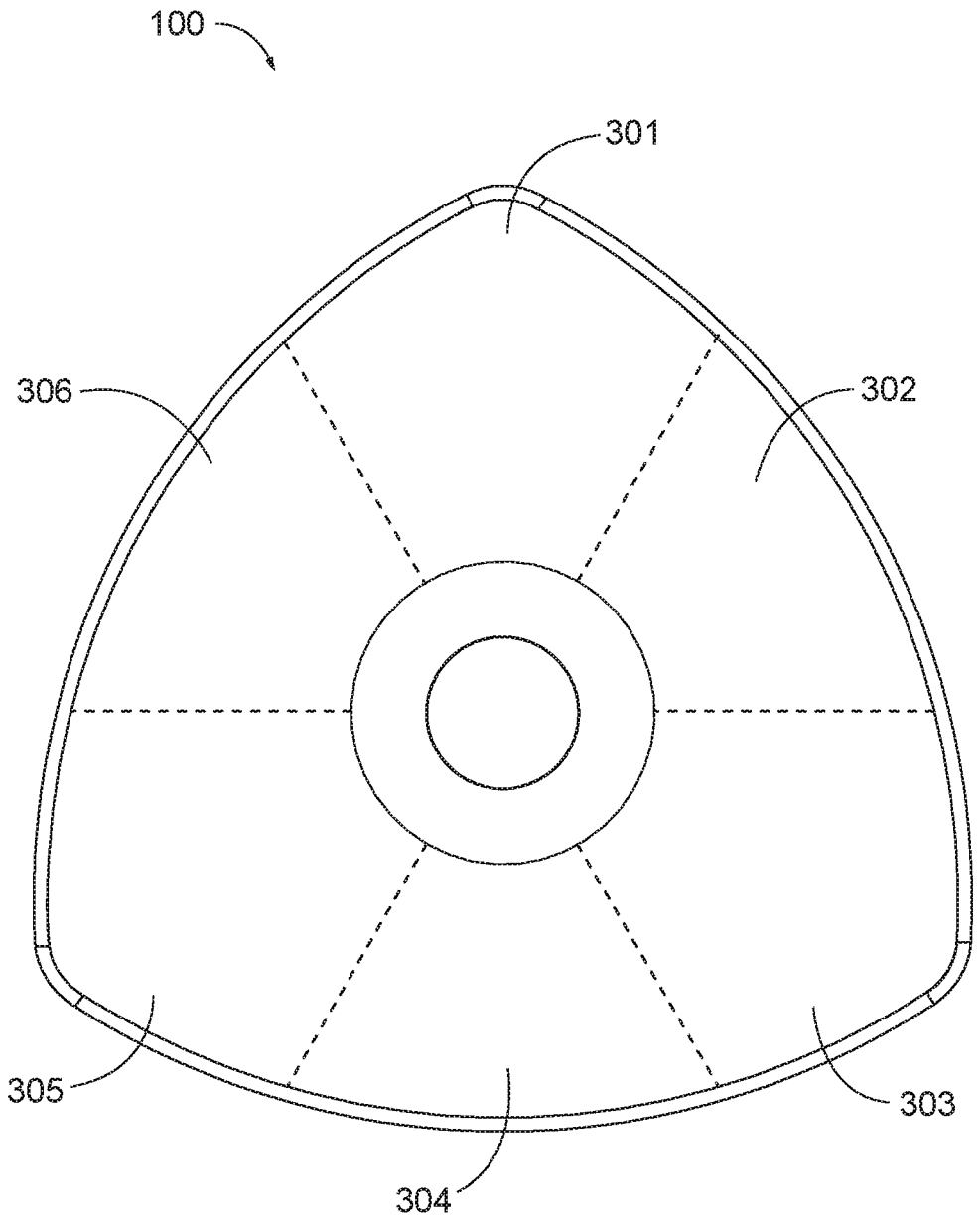
FIG. 15 is a simulated view of the light indicator of FIG. 1 depicting the boundaries of the segments.

Referring to FIG. 15, that figure shows a simulated image of the indicator (100) which comprises a first segment (301), a second segment (302), a third segment (303), a fourth segment (304), a fifth segment (305), and a sixth segment (306), with the dotted lines separating the segments indicating the boundary that light emitting from that segments LED (114) will be contained within. As can be seen, the first segment (301), the second segment (302), the third segment (303), the fourth segment (304), the fifth segment (305), and the sixth segment (306) are arranged about the face of a cover such as the cover (102), with each segment touching two adjacent segments in order to form a looping sequence of segments (i.e., the segments can be sequentially iterated through starting at the first segment (301) and then returning to the first segment (301) after iterating past the sixth segment (306)). It should be understood that a looping sequence of segments may also be implemented in covers of other shapes, such as triangular, square, circular, and other polygonal shapes having various sides.

Dotted lines show the separation between segments of the looping sequence of segments that may be individually lighted. As has been described above, a first segment (301) may be lit by the LED (114) contained within without any of the emitted light bleeding into a second segment (302) or a sixth segment (306) by way of divider spokes (118) and/or the other elements described above. These clean delineations between lighted segments allow a variety of light patterns to be displayed, including simultaneously lighting, flashing, strobing, or alternating between one and six segments with between one and six colors at an intensity or brightness of between about 1% and 100%. With this level of flexibility, any desired pattern of lighting, flashing, strobing, or alternating between colors can be programmed and performed by a processor at the indicator level (i.e., the processor and memory or the LED controller (206)) or based upon instructions from the indicator controller (210).

Some examples of particular behavior or modes that the indicator (100) may perform include directional mode, run mode, and gauge mode. Directional mode can be used to provide a directional indicator to a viewer of the indicator (100), when the directional orientation of the indicator (100) is known (i.e., where the positioning key (108) is used with an appropriate mounting point during installation to guarantee directional orientation) or can be assumed. With the indicator (100) installed as described, it can be seen in FIG. 15 that the first segment (301), the third segment (303), and the fifth segment (305) each appear to point in a particular direction due to Reuleaux triangle (e.g., a triangle with outwardly curved edges between points) design and shape of the indicator (100).

Thus, when installed vertically on a wall, or horizontally on a surface, these three segments can be used as directional indicators that could be lit to indicate to a nearby worker that a task exists in that direction, or that their attention should be drawn to that direction. In this manner, the indicator (100) could point to a button that must be hit, towards a container that an item must be retrieved from, towards a direction that an object may be arriving from on a conveyor belt, to a direction that a potential danger might exist in, or other similar directional instructions. Variations on such directional indicating exist and could include, for example, lighting the second segment (302) and the third segment (303) to point right, the fifth segment (305) and the sixth segment (306) to point left, the third segment (303), the fourth segment (304) and the fifth segment (305) to point down, the first segment (301), the second segment (302) and the sixth segment (306) to point up, or lighting any individual segment to point to any immediately proximate control (e.g., a button proximate to and corresponding to each segment), object, or task (e.g., a sticker or poster with instructions proximate to and corresponding to each segment) as may be desired.

Figure 16:
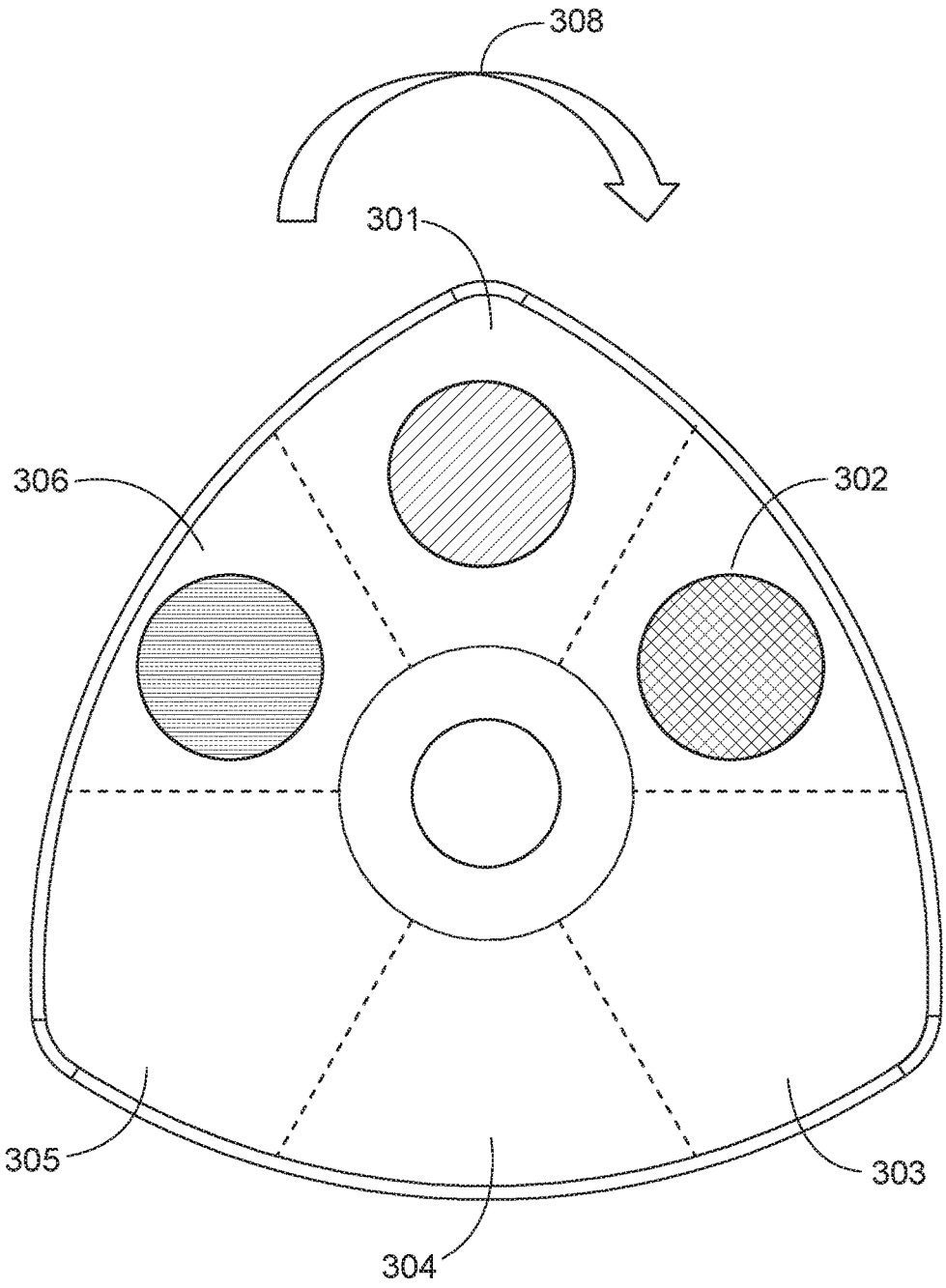
FIG. 16 is a simulated view of the light indicator of FIG. 1 during an exemplary first stage of a run light mode.
Figure 17:
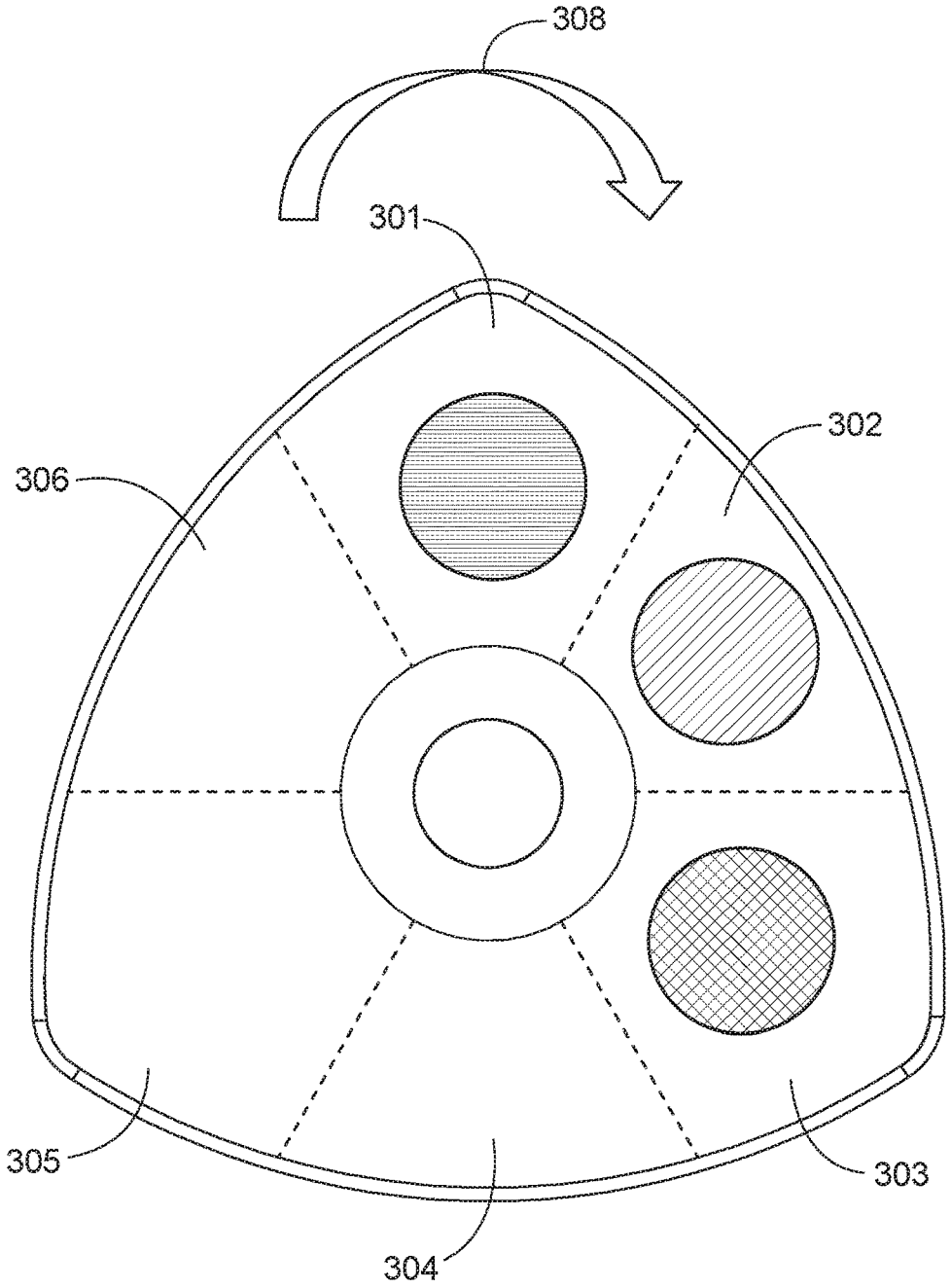
FIG. 17 is a simulated view of the light indicator of FIG. 1 during an exemplary second stage of a run light mode.

The indicator (100) may be placed into a run mode based upon a signal received from the indicator controller (210) or based upon signals originating from the indicator (100) itself. When in a run mode, the indicator (100) will light a contiguous block of one or more segments at a first period of time, then light a second contiguous block of one or more segments at a second period of time, where the first and second contiguous block are adjacent to each other. When performed multiple times in sequence, this can create a visual effect of a lighted block circling or running around the indicator in a particular direction. FIGS. 16 and 17 provide a simulated example, running in a clockwise direction (308) and using shaded circles to represent produced light. FIG. 16 shows the indicator (100) at a first period of time, with the first segment (301), the second segment (302), and the sixth segment (306) lit. FIG. 17 shows the indicator (100) at a second, subsequent period of time, with the first segment (301), the second segment (302), and the third segment (303) lit. As can be seen, the block of three lit segments appears to be moving, clockwise (308), around the indicator (100).

Segments may be lit to the same color and intensity, or different colors, or shades of colors, and intensities. For example, a second segment (302), being sequentially first in the run, may be lit the brightest, while the first segment (301), being sequentially second, may be second brightest, and the sixth segment (306) may be third brightest. This could create a further visual effect of the running block fading at the tail edge as it moves clockwise (308) around the indicator (100). Run mode may be useful to indicate a variety of situations.

For example, the indicator (100) in run mode may indicate that a particular task or occurrence is waiting for a prerequisite to be completed before it is performed. This could include a button that must be pressed after an object is placed on a conveyor belt. The indicator (100) may display in run mode until the object is placed on the conveyor belt, at which time it could switch to a directional indicator pointing at the button. As another example, run mode may indicate that a particular machine or task will be available for use or performance soon and that there is no error, and so a worker should just wait a few moments. Other exemplary uses exist and will be apparent to one of ordinary skill in the art in light of this disclosure.

The indicator (100) may be placed into a gauge mode based upon a signal received from the indicator controller (210) or based upon signals originating from the indicator (100) itself. When in gauge mode, the indicator (100) may, based upon a set of input data, light segments in a manner that visually suggests an increasing or decreasing gauge. The input data may come from, for example, an outside source such as the indicator controller (210) or another computer, machine, or sensor, or may originate from the indicator (100) itself, such as a timed process (e.g., a count-down or count-up timer), the sensor (128), or another sensor that may be connected to the indicator (100).

Figure 18:
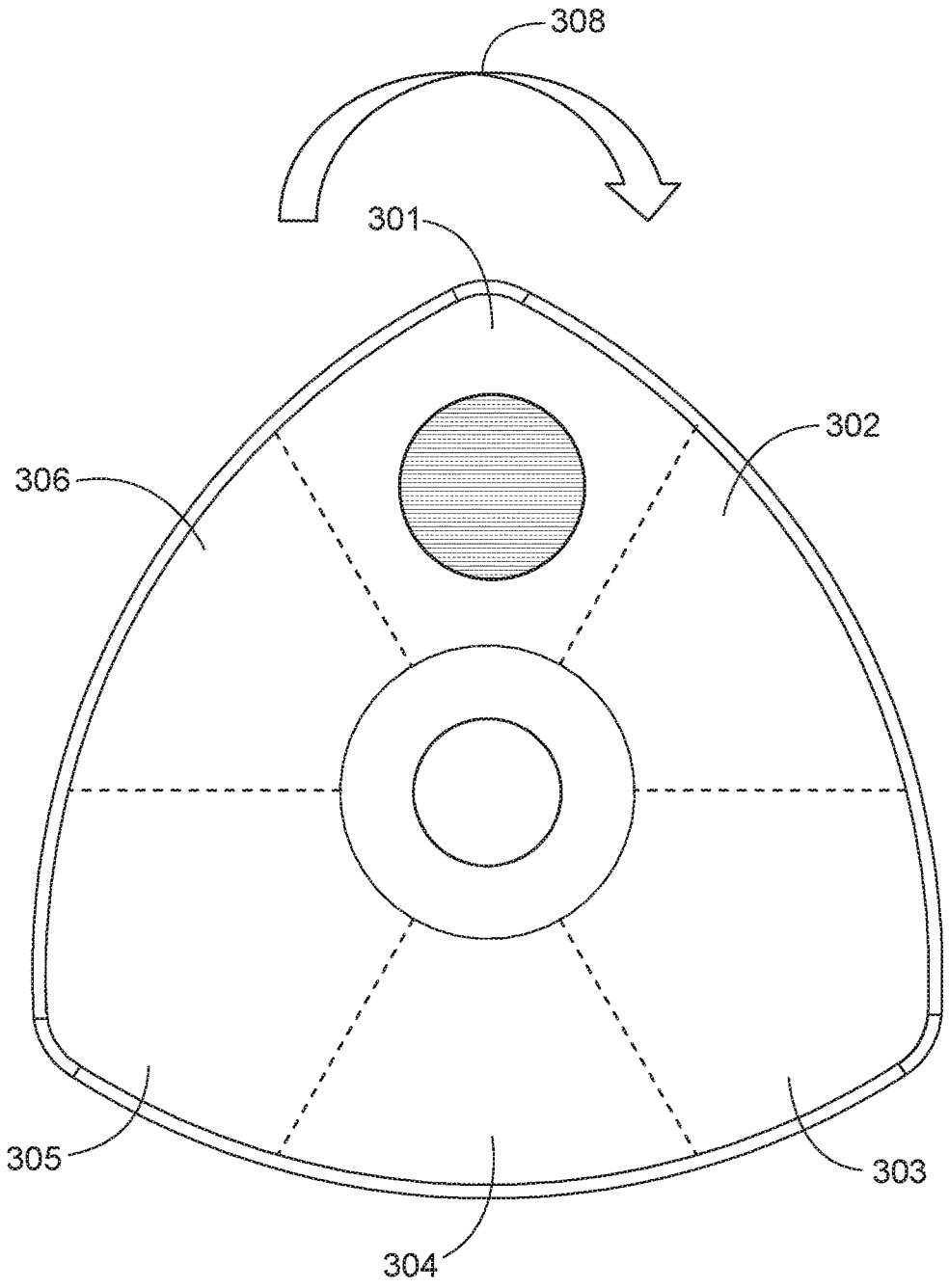
FIG. 18 is a simulated view of the light indicator of FIG. 1 during an exemplary first stage of a gauge mode.
Figure 19:
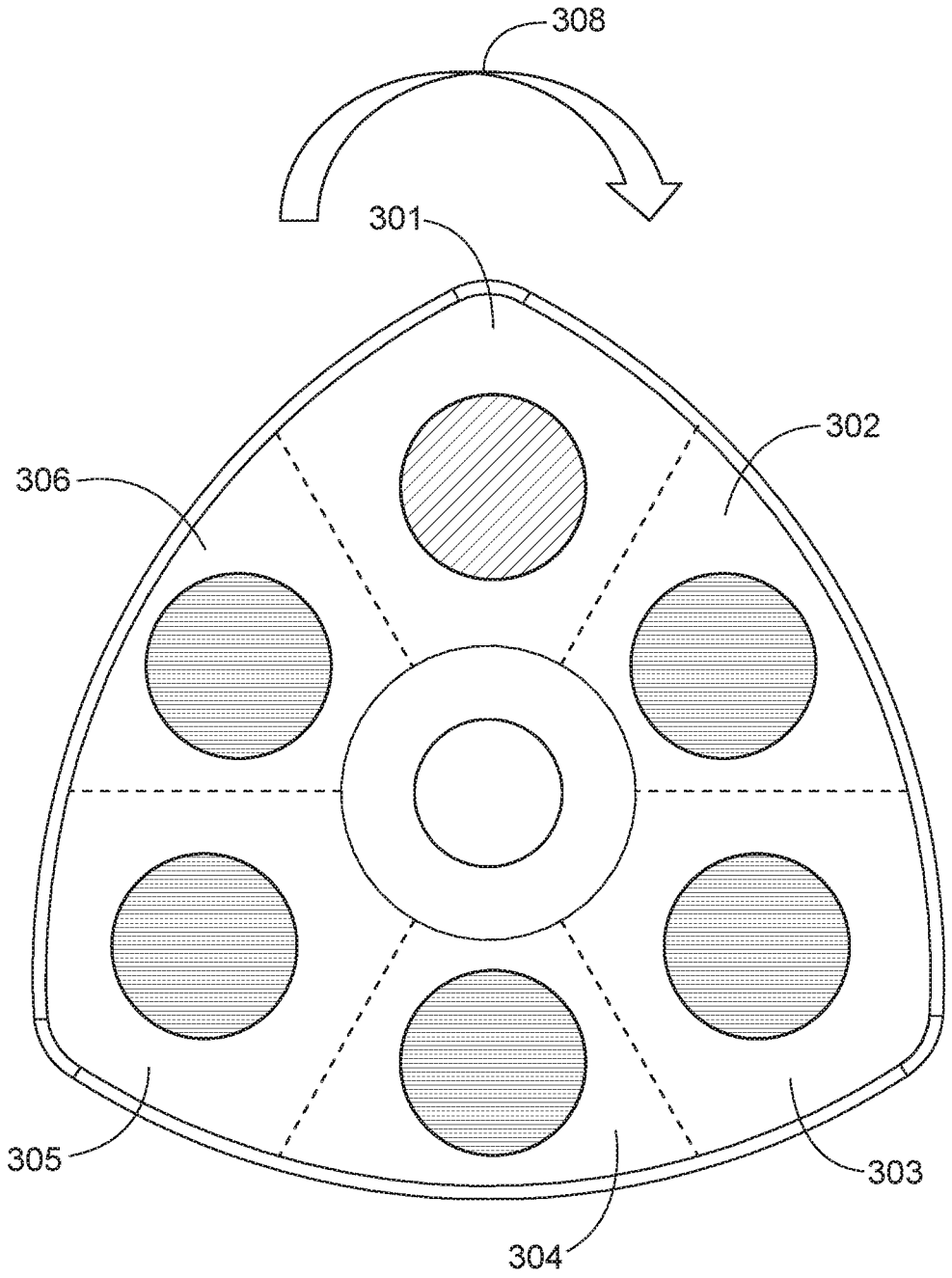
FIG. 19 is a simulated view of the light indicator of FIG. 1 during an exemplary second stage of a gauge mode.
Figure 20:
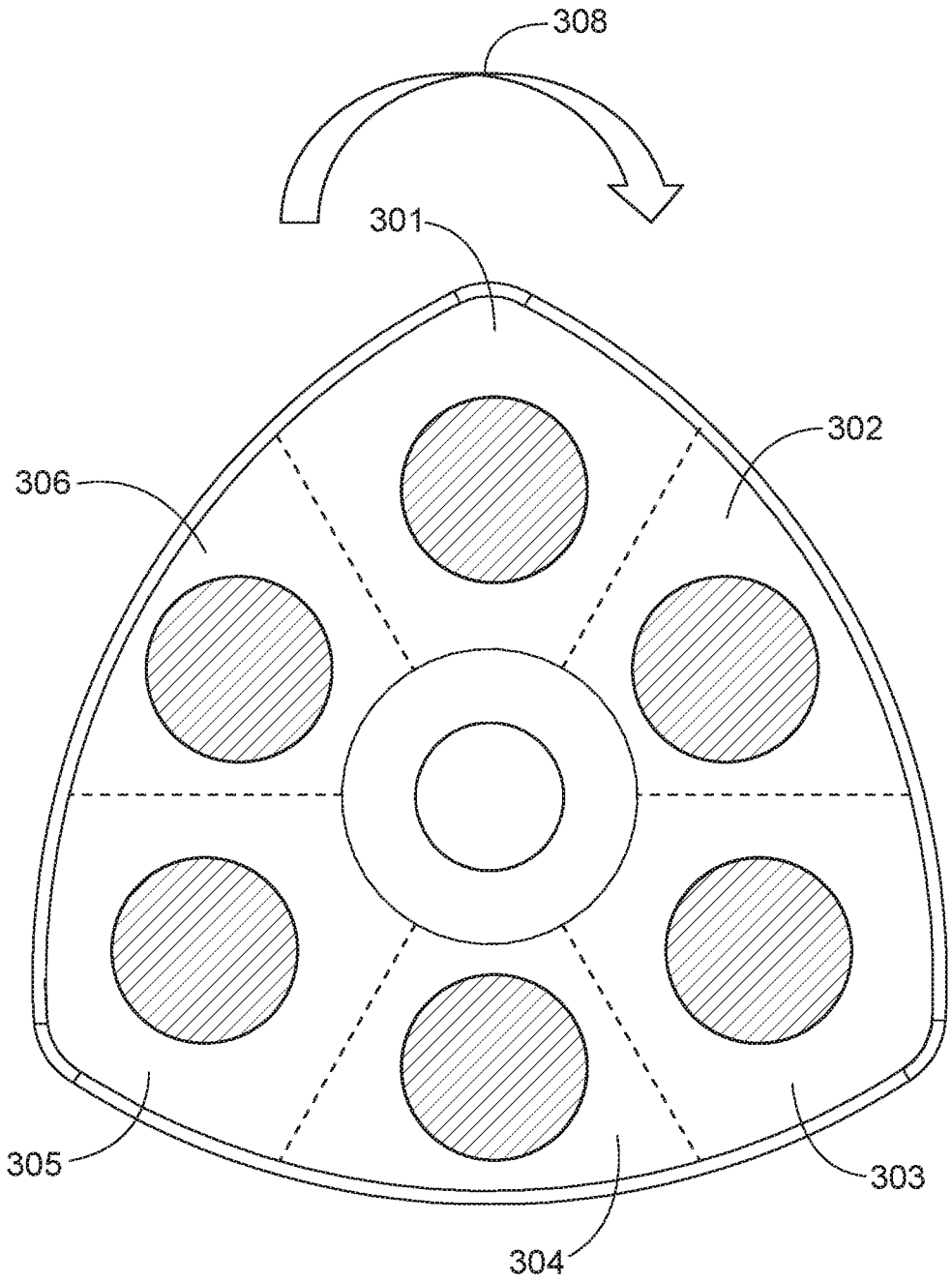
FIG. 20 is a simulated view of the light indicator of FIG. 1 during an exemplary third stage of a gauge mode.

FIGS. 18-20 provide a visual example of an indicator (100) in gauge mode. While a variety of inputs could be provided, for the sake of example it will be assumed that the indicator (100) is receiving data from a temperature sensor on a nearby machine, and that the data can be used to determine a percentage of maximum safe temperature that the nearby machine is currently operating at. The indicator (100) may determine that the temperature is currently 10%, and in response will light the first segment (301), as shown in FIG. 18, to indicate a temperature of less than 17% (i.e., 100% divided by six segments). As the temperature increases, a second segment (302) would light at around 17%, a third segment (303) would light around 34%, a fourth segment around 51%, and so on, until 100% is reached as can be seen in FIG. 19, where all segments are lit. This could be described as a single rotation gauge, and could use a single color for each lit segment, could operate in a gradient of colors with intensity or brightness increasing along the gradient as each segment is lit, or could use different colors for different segments (e.g., green for the first segment (301) and the second segment (302)), yellow for the third segment (303) and the fourth segment (304), and red for the fifth segment (305) and the sixth segment (306)).

The indicator (100) in gauge mode may support multiple rotation gauges as well. For example, referring again to FIG. 19, each segment could be representative of approximately 8% of a maximum safe value instead of 17%, with each subsequent segment lighting when the next 8% threshold is reached. The lighted segments could proceed around the indicator (100) clockwise (308) until the all six segments (e.g., the first segment (301), the second segment (302), etc.) are lit with a first color, such as yellow, and then as the percentage continues to increase the first segment (301) could shift from the first color, yellow, to a second color, such as red. The lighted segments could continue to proceed around the indicator (100) clockwise (308) until all six segments (e.g., the first segment (301), the second segment (302), etc.) are lit with the second color, red, as can be seen in FIG. 20. This could be a double rotation gauge, but it should be apparent that the same concept could support any number of desired rotations with colors, intensities, or lighting patterns changing upon each complete rotation.

While the figures have shown the indicator (100) with the case (104) and cover (102) having a profile shaped as a Reuleaux triangle, which has been discussed as offering some advantage beyond aesthetics at least in regard to directional pointing, it should also be understood that many of the concepts disclosed herein also apply to indicators (100) whose profile is square, circular, triangular, or most other shapes. Additionally, while the figures have shown the indicator (100) with six segments, it should be understood that many of the concepts disclosed herein also apply to indicators having two or more segments in general, and so indicators having three, four, or even eight segments would also be contemplated, for example. Further, while the figures have shown one LED (e.g., the LED (114)) being placed within each segment, it should be understood that there may be one or more LEDs per segment in order to allow for brighter lighting, mixed color lighting, or backup or failover lighting.

Other variations will also be apparent to one of ordinary skill in the art in light of this disclosure. For example, the indicator (100) could communicate with the indicator controller (210) or with other indicators wirelessly rather than via a direct connection or daisy-chained connection. It is also contemplated that indicators could have integrated batteries or battery packs to allow for quick installation without the need for running cables of any type. It is also contemplated that segmented light indicators such as those disclosed herein could be implemented with an LED panel display with a protective cover, which could allow for additional capabilities in terms of displaying text, video, and images in addition to vivid and clearly segmented colored light. It is also contemplated that the cover (102) and the divider wheel (112) could be produced as a single unibody piece comprising two different materials (e.g., an opaque plastic for the divider wheel (112) and a translucent plastic for the cover (102)) that are molded together, which could advantageously allow the spoke top edge (111) of each divider spoke (118) to embed to some depth within the cover (102) material rather than just resting against it, which may further prevent the spread of emitted light into adjacent segments.

It should be understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Example 1

An indicator comprising: (a) a case comprising a light emitting portion; (b) a divider positioned within the case and adapted to separate the light emitting portion into a set of segments; (c) a set of indicator lights positioned within the case; and (d) a controller operable to control illumination of the set of indicator lights; wherein the controller is configured to selectively illuminate one or more of the of the set of indicator lights to cause a corresponding segments of the set of segments to illuminate.

Example 2

The indicator of Example 1, wherein each segment of the set of segments is intermediate at least two other segments of the set of segments.

Example 3

The indicator of Example 2, wherein: (a) the light emitting portion comprises a cover adapted to fit the case and partially enclose an interior of the case, (b) the cover comprises a triangular shaped surface comprising three vertices, and (c) each of the three vertices corresponds to a segment of the set of segments.

Example 4

The indicator of Example 3, wherein the triangular shaped surface is a Reuleaux triangular shape.

Example 5

The indicator of any one or more of Examples 3 through 4, further comprising a mount adapted to attach the indicator to a point-of-use and a positioning key adapted to ensure that, when the indicator is attached to the point-of-use, each of the three vertices points in a direction that is predetermined for that vertex.

Example 6

The indicator of any one or more of Examples 1 through 5, wherein the controller is configured to, for each indicator light of the set of indicator lights: (a) cause that indicator light to emit light of a configured intensity, and (b) cause that indicator light to emit light of a configured color.

Example 7

The indicator of Example 6, further comprising an IO-link adapter configured to receive data when connected to an IO-link interface, wherein the configured intensity and the configured color are determined based upon a control signal received by the controller from the IO-link interface.

Example 8

The indicator of any one or more of Examples 1 through 7, wherein the light emitting portion comprises a cover adapted to fit the case and cover an interior, and wherein: (a) the divider comprises a hub with a set of spokes extending outwards, wherein the set of spokes define a set of sections within the case, (b) wherein each spoke of the set of spokes comprises a top edge adapted to abut an interior wall of the cover and a distal edge adapted to abut an interior lip of the cover, and (c) the divider is substantially opaque such that light emitted by a light indicator into any section of the set of sections is substantially prevented from passing into any adjacent section.

Example 9

The indicator of Example 8, wherein the cover further comprises a set of interior steps that touch and pair with the set of spokes when the divider is coupled with the cover.

Example 10

The indicator of Example 9, wherein the cover is comprised of a polycarbonate that allows a light transmission of between about 65% to about 85% and a haze of between about 85% to about 100% at a thickness of 1.0 mm.

Example 11

The indicator of any one or more of Examples 9 through 10, wherein each of the set of interior steps: (a) extend from the cover between about 0.1 mm and about 1.5 mm, (b) are a width that substantially matches a width of each of the set of spokes where a step touches a spoke, and (c) are adapted to reduce flashing between the set of segments.

Example 12

The indicator of any one or more of Examples 1 through 11, wherein: (a) the divider comprises a hub with a set of spokes extending outwards, wherein the set of spokes define a set of sections within the case, and (b) wherein each spoke of the set of spokes extends from a top edge having a top thickness and a bottom edge having a bottom thickness, wherein the top thickness is greater than the bottom thickness.

Example 13

An indicator comprising: (a) a cover adapted to allow the passage of light, wherein the cover comprises a set of segments, and wherein each segment of the set of segments is positioned next to and touches at least two other segments of the set of segments to form a looping sequence of segments; (b) a set of light indicators positioned within the indicator and operable to selectively illuminate one or more of the set of segments; (c) a controller configured to control a set of illumination characteristics of the set of light indicators; wherein the controller is further configured to: (i) receive a set of indicator pattern signals, and (ii) individually control the set of illumination characteristics of each of the set of light indicators based upon the indicator pattern signal.

Example 14

The indicator of Example 13, further comprising an IO-link adapter configured to receive data when connected to an IO-link interface, wherein: (a) the set of indicator pattern signals is received from the IO-link interface, and (b) the set of illumination characteristics include an illumination status, an illumination intensity, and an illumination color.

Example 15

The indicator of any one or more of Examples 13 through 14, wherein the controller is further configured to, in response to a run mode signal of the set of indicator pattern signals: (a) light a first segment of the set of segments at a first intensity, light a second segment that is adjacent to the first segment at a second intensity, and light a third segment that is adjacent to the second segment at a third intensity to create a running block, and (b) repeatedly shift the set of illumination characteristics for each light indicator to an adjacent light indicator, in the same direction, and cause the running block to iterate through the looping sequence of segments.

Example 16

The indicator of Example 15, wherein the first intensity is greater than the second intensity, and the second intensity is greater than the third intensity.

Example 17

The indicator of any one or more of Examples 13 through 16, wherein the controller is further configured to, in response to a gauge mode signal of the set of indicator pattern signals: (a) starting at a first segment of the looping sequence of segments, light one or more segments of the looping sequence of segments, in sequence, based upon a gauge value of the gauge mode signal, wherein the number of the one or more segments that are lit is proportional to the gauge value, and (b) repeatedly change the number of the one or more segments that are lit as the gauge value changes in response to additional gauge mode signals.

Example 18

The indicator of Example 17, wherein the controller is further configured to: (a) after a last segment of the looping sequence of segments is lit based upon the gauge value, change an illumination color of the first segment of the looping sequence to a new illumination color based upon a change in the gauge value, and (b) starting at the first segment, light one or more segments of the looping sequence of segments with the new illumination color, in sequence, based upon the gauge value, wherein the number of the one or more segments that are lit with the new illumination color is proportional to the gauge value.

Example 19

The indicator of any one or more of Examples 13 through 18, further comprising a mount adapted to attach the indicator to a point-of-use and a positioning key adapted to ensure that, when the indicator is attached to the point-of-use, the position of each of the set of segments is pre-determined, wherein the controller is further configured to, in response to a directional signal of the set of indicator pattern signals: (a) determine a direction associated with the directional signal, wherein the direction is associated with the physical space in which the point-of-use is located, (b) determine one or more segments of the set of segments that are associated with the direction based upon the pre-determined position of each of the set of segments, and (c) light each of the one or more segments to indicate the direction.

Example 20

An indicator comprising: (a) a case; (b) a cover, wherein the cover is adapted to allow the passage of light therethrough, wherein the case and cover define an interior; (c) a divider comprising a hub with a set of six spokes extending outwards from a central axis, wherein, when the divider is placed within the interior: (i) a top edge of each of the set of six spokes abuts the cover such that the set of six spokes define a set of six segments of the cover, wherein each segment of the set of six segments abuts two other segments of the set of six segments to form a looping sequence of segments, (ii) the set of six spokes define a set of six sections within the interior, and (iii) each of the set of six segments corresponds to a different of the set of six sections, (d) a set of light indicators, wherein each section of the set of six sections contains at least one light indicator of the set of light indicators, and wherein each of the set of light indicators are individually operable to illuminate a corresponding segment of the set of six segments; (e) a controller configured to control a set of illumination characteristics of the set of light indicators; (f) a mount adapted to attach the indicator to a point-of-use, the mount comprising a positioning key adapted to ensure that, when the indicator is attached to the point-of-use, the position of each of the set of six segments is pre-determined; wherein the controller is further configured to receive a directional signal, and in response to the directional signal: (i) determine a direction associated with the directional signal, wherein the direction is associated with the physical space in which the point-of-use is located, (ii) determine one or more segments of the set of six segments that are associated with the direction based upon the pre-determined position of each of the set of six segments, and (iii) light each of the one or more segments to indicate the direction.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. An indicator comprising:

(a) a case comprising a light emitting portion, wherein the light emitting portions comprises a cover adapted to fit the case and partially enclose an interior of the case;

(b) a divider positioned within the case and adapted to separate the light emitting portion into a set of segments, wherein each segment of the set of segments is intermediate at least two other segments of the set of segments;

(c) a set of indicator lights positioned within the case; and (d) a controller operable to control illumination of the set of indicator lights;

wherein:

(i) the controller is configured to selectively illuminate one or more of the of the set of indicator lights to cause a corresponding segment of the set of segments to illuminate, (ii) the cover comprises a triangular shaped surface comprising three vertices, and (iii) each of the three vertices corresponds to a segment of the set of segments.

2. The indicator of claim 1, wherein the triangular shaped surface is a Reuleaux triangular shape.

3. The indicator of claim 1, further comprising a mount adapted to attach the indicator to a point-of-use and a positioning key adapted to ensure that, when the indicator is attached to the point-of-use, each of the three vertices points in a direction that is pre-determined for that vertex.

4. The indicator of claim 1, wherein the controller is configured to, for each indicator light of the set of indicator lights:

(a) cause that indicator light to emit light of a configured intensity, and (b) cause that indicator light to emit light of a configured color.

5. The indicator of claim 4, further comprising an IO-link adapter configured to receive data when connected to an IO-link interface, wherein the configured intensity and the configured color are determined based upon a control signal received by the controller from the IO-link interface.

6. The indicator of claim 1, wherein:

(a) the divider comprises a hub with a set of spokes extending outwards, wherein the set of spokes define a set of sections within the case, (b) wherein each spoke of the set of spokes comprises a top edge adapted to abut an interior wall of the cover and a distal edge adapted to abut an interior lip of the cover, and (c) the divider is substantially opaque such that light emitted by a light indicator into any section of the set of sections is substantially prevented from passing into any adjacent section.

7. The indicator of claim 6, wherein the cover further comprises a set of interior steps that touch and pair with the set of spokes when the divider is coupled with the cover.

8. The indicator of claim 7, wherein the cover is comprised of a polycarbonate that allows a light transmission of between about 65% to about 85% and a haze of between about 85% to about 100% at a thickness of 1.0 mm.

9. The indicator of claim 7, wherein each of the set of interior steps:

(a) extend from the cover between about 0.1 mm and about 1.5 mm, (b) are a width that substantially matches a width of each of the set of spokes where a step touches a spoke, and (c) are adapted to reduce flashing between the set of segments.

10. The indicator of claim 1, wherein:

(a) the divider comprises a hub with a set of spokes extending outwards, wherein the set of spokes define a set of sections within the case, and (b) wherein each spoke of the set of spokes extends from a top edge having a top thickness and a bottom edge having a bottom thickness, wherein the top thickness is greater than the bottom thickness.

11. An indicator comprising:

(a) a cover adapted to allow the passage of light, wherein the cover comprises a set of segments, and wherein each segment of the set of segments is positioned next to and touches at least two other segments of the set of segments to form a looping sequence of segments;

(b) a set of light indicators positioned within the indicator and operable to selectively illuminate one or more of the set of segments; and (c) a controller configured to control a set of illumination characteristics of the set of light indicators;

wherein the controller is further configured to:

(i) receive a set of indicator pattern signals, and (ii) individually control the set of illumination characteristics of each of the set of light indicators based upon the indicator pattern signal; and wherein the controller is further configured to, in response to a run mode signal of the set of indicator pattern signals:

(A) light a first segment of the set of segments at a first intensity, light a second segment that is adjacent to the first segment at a second intensity, and light a third segment that is adjacent to the second segment at a third intensity to create a running block, and (B) repeatedly shift the set of illumination characteristics for each light indicator to an adjacent light indicator, in the same direction, and cause the running block to iterate through the looping sequence of segments.

12. The indicator of claim 11, further comprising an IO-link adapter configured to receive data when connected to an IO-link interface, wherein:

(a) the set of indicator pattern signals is received from the IO-link interface, and (b) the set of illumination characteristics include an illumination status, an illumination intensity, and an illumination color.

13. The indicator of claim 11, wherein the first intensity is greater than the second intensity, and the second intensity is greater than the third intensity.

14. The indicator of claim 11, wherein the controller is further configured to, in response to a gauge mode signal of the set of indicator pattern signals:

(a) starting at a first segment of the looping sequence of segments, light one or more segments of the looping sequence of segments, in sequence, based upon a gauge value of the gauge mode signal, wherein the number of the one or more segments that are lit is proportional to the gauge value, and (b) repeatedly change the number of the one or more segments that are lit as the gauge value changes in response to additional gauge mode signals.

15. The indicator of claim 14, wherein the controller is further configured to:

(a) after a last segment of the looping sequence of segments is lit based upon the gauge value, change an illumination color of the first segment of the looping sequence to a new illumination color based upon a change in the gauge value, and (b) starting at the first segment, light one or more segments of the looping sequence of segments with the new illumination color, in sequence, based upon the gauge value, wherein the number of the one or more segments that are lit with the new illumination color is proportional to the gauge value.

16. The indicator of claim 11, further comprising a mount adapted to attach the indicator to a point-of-use and a positioning key adapted to ensure that, when the indicator is attached to the point-of-use, the position of each of the set of segments is pre-determined, wherein the controller is further configured to, in response to a directional signal of the set of indicator pattern signals:

(a) determine a direction associated with the directional signal, wherein the direction is associated with the physical space in which the point-of-use is located, (b) determine one or more segments of the set of segments that are associated with the direction based upon the pre-determined position of each of the set of segments, and (c) light each of the one or more segments to indicate the direction.

17. An indicator comprising:

(a) a case;

(b) a cover, wherein the cover is adapted to allow the passage of light therethrough, wherein the case and cover define an interior;

(c) a divider comprising a hub with a set of six spokes extending outwards from a central axis, wherein, when the divider is placed within the interior:

(i) a top edge of each of the set of six spokes abuts the cover such that the set of six spokes define a set of six segments of the cover, wherein each segment of the set of six segments abuts two other segments of the set of six segments to form a looping sequence of segments, (ii) the set of six spokes define a set of six sections within the interior, and (iii) each of the set of six segments corresponds to a different of the set of six sections, (d) a set of light indicators, wherein each section of the set of six sections contains at least one light indicator of the set of light indicators, and wherein each of the set of light indicators are individually operable to illuminate a corresponding segment of the set of six segments;

(e) a controller configured to control a set of illumination characteristics of the set of light indicators;

(f) a mount adapted to attach the indicator to a point-of-use, the mount comprising a positioning key adapted to ensure that, when the indicator is attached to the point-of-use, the position of each of the set of six segments is pre-determined;

wherein the controller is further configured to receive a directional signal, and in response to the directional signal:

(i) determine a direction associated with the directional signal, wherein the direction is associated with the physical space in which the point-of-use is located, (ii) determine one or more segments of the set of six segments that are associated with the direction based upon the pre-determined position of each of the set of six segments, and (iii) light each of the one or more segments to indicate the direction.

18. An indicator comprising:

(a) a cover adapted to allow the passage of light, wherein the cover comprises a set of segments, and wherein each segment of the set of segments is positioned next to and touches at least two other segments of the set of segments to form a looping sequence of segments;

(b) a set of light indicators positioned within the indicator and operable to selectively illuminate one or more of the set of segments; and (c) a controller configured to control a set of illumination characteristics of the set of light indicators;

wherein the controller is further configured to:

(i) receive a set of indicator pattern signals, and (ii) individually control the set of illumination characteristics of each of the set of light indicators based upon the indicator pattern signal; and wherein the controller is further configured to, in response to a gauge mode signal of the set of indicator pattern signals:

(A) starting at a first segment of the looping sequence of segments, light one or more segments of the looping sequence of segments, in sequence, based upon a gauge value of the gauge mode signal, wherein the number of the one or more segments that are lit is proportional to the gauge value, and (B) repeatedly change the number of the one or more segments that are lit as the gauge value changes in response to additional gauge mode signals.

19. An indicator comprising:

(a) a cover adapted to allow the passage of light, wherein the cover comprises a set of segments, and wherein each segment of the set of segments is positioned next to and touches at least two other segments of the set of segments to form a looping sequence of segments;

(b) a set of light indicators positioned within the indicator and operable to selectively illuminate one or more of the set of segments;

(c) a controller configured to control a set of illumination characteristics of the set of light indicators; and (d) a mount adapted to attach the indicator to a point-of-use and a positioning key adapted to ensure that, when the indicator is attached to the point-of-use, the position of each of the set of segments is pre-determined;

wherein the controller is further configured to:

(i) receive a set of indicator pattern signals, and (ii) individually control the set of illumination characteristics of each of the set of light indicators based upon the indicator pattern signal; and wherein the controller is further configured to, in response to a directional signal of the set of indicator pattern signals:

(A) determine a direction associated with the directional signal, wherein the direction is associated with the physical space in which the point-of-use is located, (B) determine one or more segments of the set of segments that are associated with the direction based upon the pre-determined position of each of the set of segments, and (C) light each of the one or more segments to indicate the direction.

* * * * *